US007234457B2

(12) United States Patent
Bartmann et al.

(10) Patent No.: US 7,234,457 B2
(45) Date of Patent: Jun. 26, 2007

(54) HOUSEHOLD-APPLIANCE DOOR AND HOUSEHOLD APPLIANCE

(75) Inventors: Frank Bartmann, Hambrücken (DE); Jochen Herbolsheimer, Trostberg (DE); Horst Krenz, Bretten-Ruit (DE); Heiko Meyer, Walzbachtal (DE)

(73) Assignee: BSH Bosch und Hausgeraete GmbH, Munich (DE)

( * ) Notice: Subject to any disclaimer, the term of this patent is extended or adjusted under 35 U.S.C. 154(b) by 0 days.

(21) Appl. No.: 10/928,233

(22) Filed: Aug. 27, 2004

(65) Prior Publication Data

US 2005/0023843 A1 Feb. 3, 2005

Related U.S. Application Data

(63) Continuation of application No. PCT/EP03/01452, filed on Feb. 13, 2003.

(30) Foreign Application Priority Data

Feb. 27, 2002 (DE) ..... 102 08 494

(51) Int. Cl.
*F24C 15/02* (2006.01)

(52) U.S. Cl. ..... 126/192; 126/273 R; 49/339

(58) Field of Classification Search ..... 126/190, 126/191, 197, 192, 194, 273 R, 19 R; 16/110.1, 16/412; 292/216, 198, 229, DIG. 69; 312/319.3, 312/323, 326, 322; 49/324, 339
See application file for complete search history.

(56) References Cited

U.S. PATENT DOCUMENTS 1,801,190 A * 4/1931 Cuffe ..... 126/191
1,969,197 A * 8/1934 Barker ..... 126/190
2,104,994 A * 1/1938 Hughes ..... 126/190
2,925,081 A * 2/1960 Shooter ..... 126/190
3,263,674 A * 8/1966 Macaulay ..... 126/191
4,082,077 A * 4/1978 Marfatia et al. ..... 126/197

FOREIGN PATENT DOCUMENTS

| | | | |
|---|---|---|---|
| DE | 27 40 462 A1 | | 3/1979 |
| DE | 39 35 803 A1 | * | 5/1991 |
| EP | 0 659 960 A2 | | 6/1995 |
| EP | 1 055 882 A2 | | 11/2000 |
| EP | 1 174 668 A1 | * | 1/2002 |
| FR | 2 616 832 A1 | | 12/1988 |
| GB | 2 183 152 A | | 6/1987 |

* cited by examiner

*Primary Examiner*—Josiah C. Cocks
(74) *Attorney, Agent, or Firm*—Russell W. Warnock; Craig J. Loest

(57) ABSTRACT

A door for household appliances, in particular, a door for cooking appliances, are mounted to pivot about an articulation axis include a door handle that can be pivoted about a door-handle axis that runs parallel to the articulation axis and is connected to at least one control mechanism. When the door is pivoted in a first pivoting direction, the control mechanism pivots the door handle in a second pivoting direction that is opposite to the first. According to the invention, to obtain a reliable actuation of the door handle, a protective device is allocated to the control mechanism and prevents the pivoting motion of the door handle, during the actuation of the latter, from being transmitted to the control mechanism.

25 Claims, 18 Drawing Sheets

M1
M2
19
17
r1
47
F
17
r2
35
21
43
75
41
38
48
39
77
25
79
63
59
54
76
62
67
57
129

HOUSEHOLD-APPLIANCE DOOR AND HOUSEHOLD APPLIANCE

CROSS-REFERENCE TO RELATED APPLICATION

This application is a continuation, under 35 U.S.C. § 120, of copending international application No. PCT/EP03/01452, filed Feb. 13, 2003, which designated the United States; this application also claims the priority, under 35 U.S.C. § 119, of German patent application No. 102 08 494.7, filed Feb. 27, 2002; the prior applications are herewith incorporated by reference in their entirety.

BACKGROUND OF THE INVENTION

Field of the Invention

The present invention relates to a household appliance and to a household-appliance door that is mounted such that it can be pivoted about a hinge pin or articulation axis, having a door handle that can be pivoted about a door-handle axis running parallel to the articulation axis and connected to at least one control mechanism that, when the door is pivoted in a first pivoting direction, pivots the door handle in a second pivoting direction, counter to the first pivoting direction.

European Patent Application EP 0 659 960 discloses a generic door that is mounted pivotable about a hinge pin and has a handle element. The handle element is mounted in the door in a manner such that it can pivot about an axis running parallel to the hinge pin of the door. The spatial alignment or orientation of the handle element is retained substantially independently of the door position. A control mechanism is disposed between the handle element and a positionally fixed region delimiting the door, and is intended for transmitting the pivoting movement of the door to the door handle.

British Patent No. GB 21 83 152 discloses a door handle configuration having a door handle that can be pivoted about an axis running parallel to the hinge pin of the door. The door handle can be pivoted between a first position, in which the door is closed, and a second position, in which the door is open. The door handle configuration has a pre-stressing device that is connected to the door handle to pre-stress the door handle towards the first position. The door handle configuration has a housing that is fitted into the door structure.

SUMMARY OF THE INVENTION

It is accordingly an object of the invention to provide a household appliance and household appliance door that overcome the hereinafore-mentioned disadvantages of the heretofore-known devices of this general type and in which the door handle can be actuated in an operationally reliable manner. With the foregoing and other objects in view, there is provided, in accordance with the invention, a household appliance door to be mounted pivotally about a hinge pin, the door including a door body configured to pivot about the hinge pin, the door body having a door handle pivotally disposed in the door body about a door handle axis disposed parallel to the hinge pin, at least one control mechanism operatively connected to the door handle to, during a pivoting of the door body in a first pivoting direction, pivot the door handle in a second pivoting direction opposite the first pivoting direction, and the at least one control mechanism having a safeguarding device preventing the pivoting movement of the door handle from being transmitted from the door handle to the at least one control mechanism during actuation of the door handle.

With the objects of the invention in view, there is also provided a household cooking appliance, including a housing having a hinge pin and a door according to the invention.

According to the invention, the control mechanism of the door has a safeguarding device. With the aid of the safeguarding device, during actuation of the door handle, the pivoting movement is prevented from being transmitted from the door handle to the control mechanism. A pivoting movement to which the door handle is subjected by a user is, thus, not introduced into the control mechanism, as a result of which, damage to the control mechanism is avoided.

In accordance with another feature of the invention, the safeguarding device is formed by a blocking element that can be adjusted into a blocking position. In the blocking position, the blocking element prevents the pivoting movement of the door handle. Such a blocking element can be used, in particular, during transportation of the household appliance. In the blocking position, the door handle is fixed and can be used to carry the household appliance without the control mechanism being damaged. Because, in an installed position of the household appliance, the door handle is no longer used as transporting measures, it is possible, in the installed position, for the blocking element to be adjusted into the release position.

In accordance with a further feature of the invention, the safeguarding device is formed by a freewheel coupling. The freewheel coupling uncouples the door handle from the control mechanism when the pivoting movement is transmitted from the door handle to the control mechanism. It is advantageous here that the control mechanism is safeguarded permanently against a pivoting movement emanating from the door handle without there being any need for additional handling steps, e.g., displacing a blocking element into the blocking position.

In accordance with an added feature of the invention, to prevent, in as straightforward a manner as possible, the pivoting movement from being transmitted from the door handle to the control mechanism, the safeguarding device, in a particularly advantageous configuration of the invention, is formed by a tension spring. The tension spring, when the pivoting movement is transmitted from the door handle to the control mechanism, absorbs the movement of the door handle.

In accordance with an additional feature of the invention, the spring element exerts a first torque in a pivoting direction of the door handle. The door handle can, thus, be prestressed against an end stop in this pivoting direction.

In accordance with yet another feature of the invention, the control mechanism can subject the door handle to a second torque. This second torque counteracts the first torque. The pivoting position of the door handle is, thus, defined in dependence on the magnitude of the torque.

In accordance with yet a further feature of the invention, it is advantageous if, for exerting the first torque, the control mechanism has a pulling element that is provided between the tension spring and the door handle and acts on the door handle such that it is spaced apart from the door-handle axis through a first lever-arm length. The tension spring may, thus, be disposed separately from the door handle. Consequently, on one hand, the position of the tension spring can be freely selected; on the other hand, it is also possible to select the size of the spring regardless of the geometrical conditions on the door handle.

In accordance with yet an added feature of the invention, it is also advantageous if, for exerting the second torque, use is made of a further, second pulling element that acts on the door handle such that it is spaced apart from the door-handle axis through a second lever-arm length. The door handle is, advantageously, pivoted merely by tensile forces acting on it; the pulling element used may, thus, be a cost-effective pulling cable that transmits only tensile forces and no shear forces.

In accordance with yet an additional feature of the invention, for the magnitude of the torques to which the door handle is subjected to be adjusted in a suitable manner in accordance with the pivoting position of the door handle, the first and/or second lever-arm length(s) may change in dependence on the pivoting position of the door handle. To avoid drive losses in the control mechanism—for example, on account of stretching of pulling elements—it is possible for the length of the first lever arm to be configured to be comparatively long at the beginning of an opening movement of the door from the closed position, while the lever-arm length becomes smaller during a further pivoting movement.

In accordance with again another feature of the invention, so that the course taken by the first and second pulling elements of the control mechanism can be freely selected, the control mechanism advantageously has at least one deflecting roller. The position of the tension spring within the door interior can, thus, be freely selected.

In accordance with again a further feature of the invention, the first and second pulling elements are guided in opposite directions over a common cam plate, which is associated in a rotationally fixed manner to the door handle. So that the first lever-arm length of the first pulling element and the second lever-arm length of the second pulling element are dimensioned in a suitable manner in dependence on the pivoting position of the door handle, the cam plate may be eccentric.

In accordance with again an added feature of the invention, the cam plate defines the first lever-arm distance and the second lever-arm distance and the first lever-arm distance is greater than the second lever-arm distance.

In accordance with again an additional feature of the invention, to ensure a smooth-running and synchronous transition of the movement from the control mechanism to the door handle, it is advantageous for in each case one of the control mechanisms to be provided on each of the two opposite narrow sides of the door.

In accordance with still another feature of the invention, at least one of the control mechanism, the first pulling element, and the second pulling element are connected to keep at least one of the first and second lever-arm lengths constant regardless of a pivoting position of the door handle.

In accordance with still a further feature of the invention, there is provided a drive part connected to the door handle and the control mechanism has a pulling element connected to the drive part and closed in a loop for transmitting rotary movement of the drive part to the door handle.

In accordance with still an added feature of the invention, the control mechanism has a tensioner for tensioning the pulling element.

In accordance with still an additional feature of the invention, it is advantageous, here, if the two second pulling elements of the control mechanisms are associated with a common spring element, of which the spring ends are connected to the second pulling elements. Such a configuration ensures that the second torques of the two control mechanisms are of equal magnitude, this resulting in a synchronous pivoting movement of the door handle.

In accordance with another feature of the invention, there is provided a hinge rod, which is associated with a conventional door hinge, acts as a drive part of the control mechanism. Such a hinge has, as is known, a hinge part secured in the household appliance. Provided in the hinge, as weight-balancing measures, is at least one spring that, during the pivoting movement of the door, executes a displacement movement. By the hinge rod, the displacement movement of the spring is transmitted to the control mechanism.

In accordance with a further feature of the invention, the spring element is a tension spring having a spring force between approximately five and ten times greater than a minimum value for a spring force corresponding approximately to frictional forces having to be overcome to restore the door handle.

In accordance with an added feature of the invention, in an alternative configuration, the drive part of the control mechanism is formed by a guide element of the door; the guide element, during the pivoting movement of the door, is guided in a sliding track associated with the household appliance, and interacts with the control mechanism to transmit a movement of the guide element to the control mechanism.

In accordance with a concomitant feature of the invention, to transmit movement from the guide element to the control mechanism, the control mechanism may have a drive part with which the guide element interacts. During the pivoting movement of the door, the guide element can rotate the drive part.

Other features that are considered as characteristic for the invention are set forth in the appended claims.

Although the invention is illustrated and described herein as embodied in a household appliance and household appliance door, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
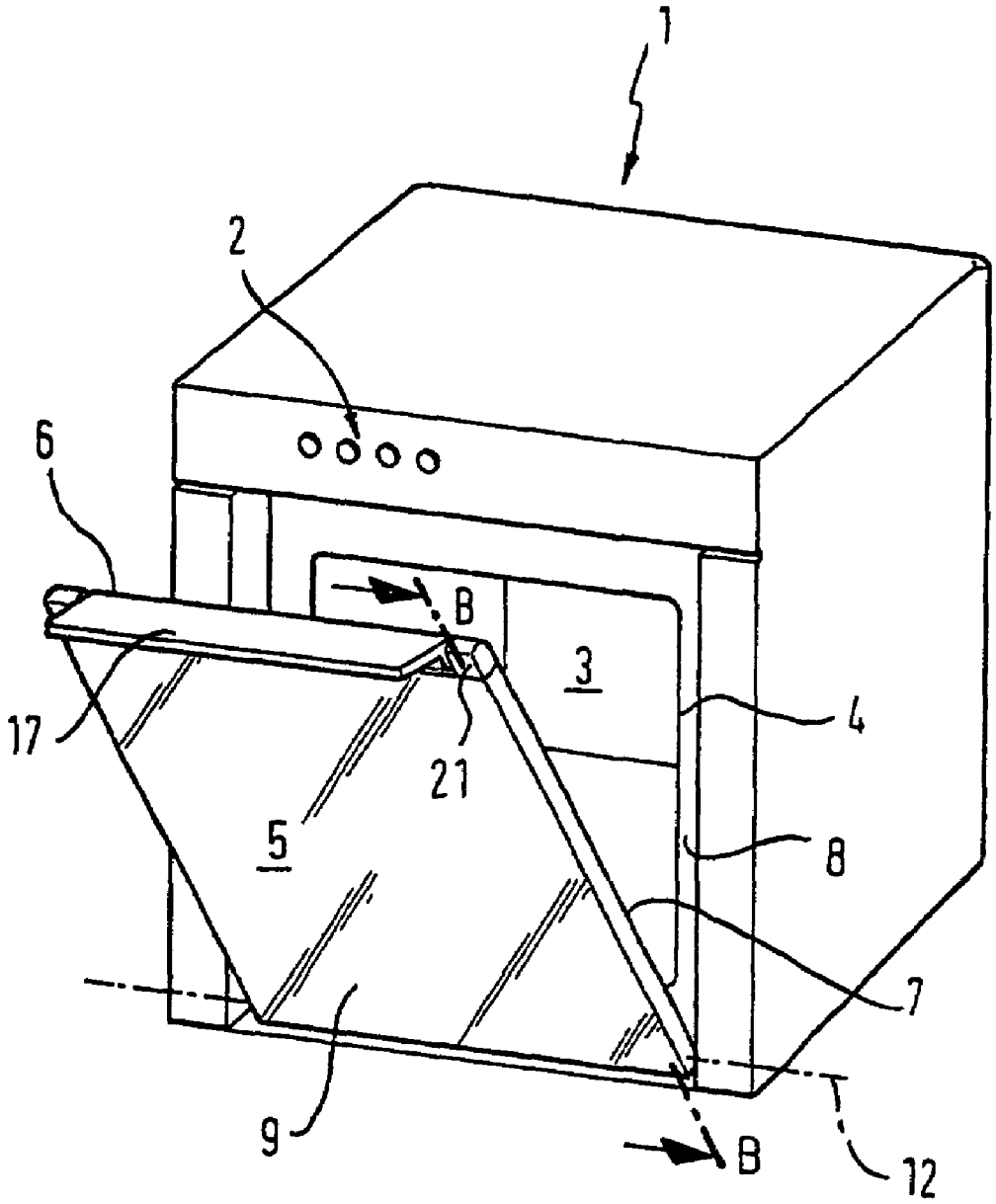
FIG. 1 is a perspective front view of a first exemplary embodiment of a cooking appliance according to the invention with an opened door.

Referring now to the figures of the drawings in detail and first, particularly to FIG. 1 thereof, there is shown a cooking appliance 1 in a first exemplary embodiment of a household appliance according to the invention. The cooking appliance 1 has front-side operating and display elements 2 with an associated non-illustrated control unit. Furthermore, a cooking space 3 is provided in the cooking appliance 1. The cooking space 3 is bounded by a muffle 4 that is open on the front side. A front-side muffle frame 8 frames the front-side opening of the muffle 4. The cooking space 3 can be closed by a door 5 that is mounted pivotally about a horizontal hinge pin or articulation axis 12. The door 5 has an inner door window 7 and an outer door window 9 of glass or glass ceramic. A door handle 17, which is mounted pivotally in a bearing housing 21, is provided on an upper end side 6 of the door 5.

Figure 2:
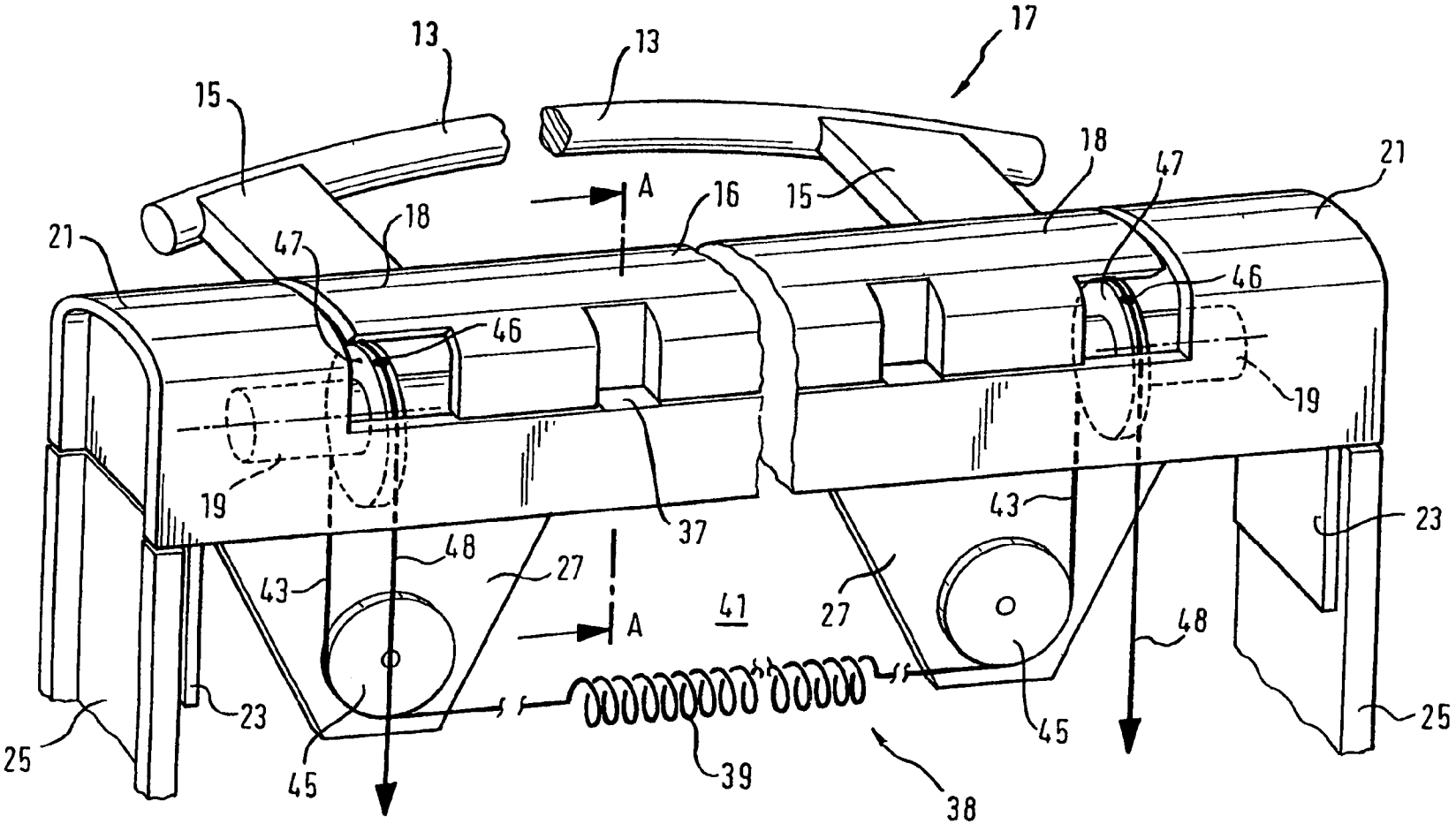
FIG. 2 is a fragmentary, enlarged perspective and partially hidden view of a cutout of a door handle according to the invention with an associated bearing housing.

FIG. 2 shows the configuration including the door handle 17 and the bearing housing 21 in a perspective illustration enlarged in some sections. For simplification purposes, the inner and outer door windows 7, 9 of the door are omitted. The door handle 17 has a handle strip 13 that is connected to a pivoting part 16 through bearing blocks 15. The pivoting part 16 forms the upper end side 6 of the door 5 and has pivot pins 19 on both sides in the longitudinal direction. The pivot pins 19 are mounted rotatably in the bearing housing 21. Both the bearing housing 21 and the pivoting part 16 are, preferably, manufactured as an injection molded part from a duroplastic (thermosetting plastic material). Stiffening elements 23 are formed on both longitudinal sides of the bearing housing 21. These stiffening elements 23 dip into an inner space 41 of the door and are fastened releasably, for example, screwed, to lateral edge strips 25 of the door 5.

Figure 3:
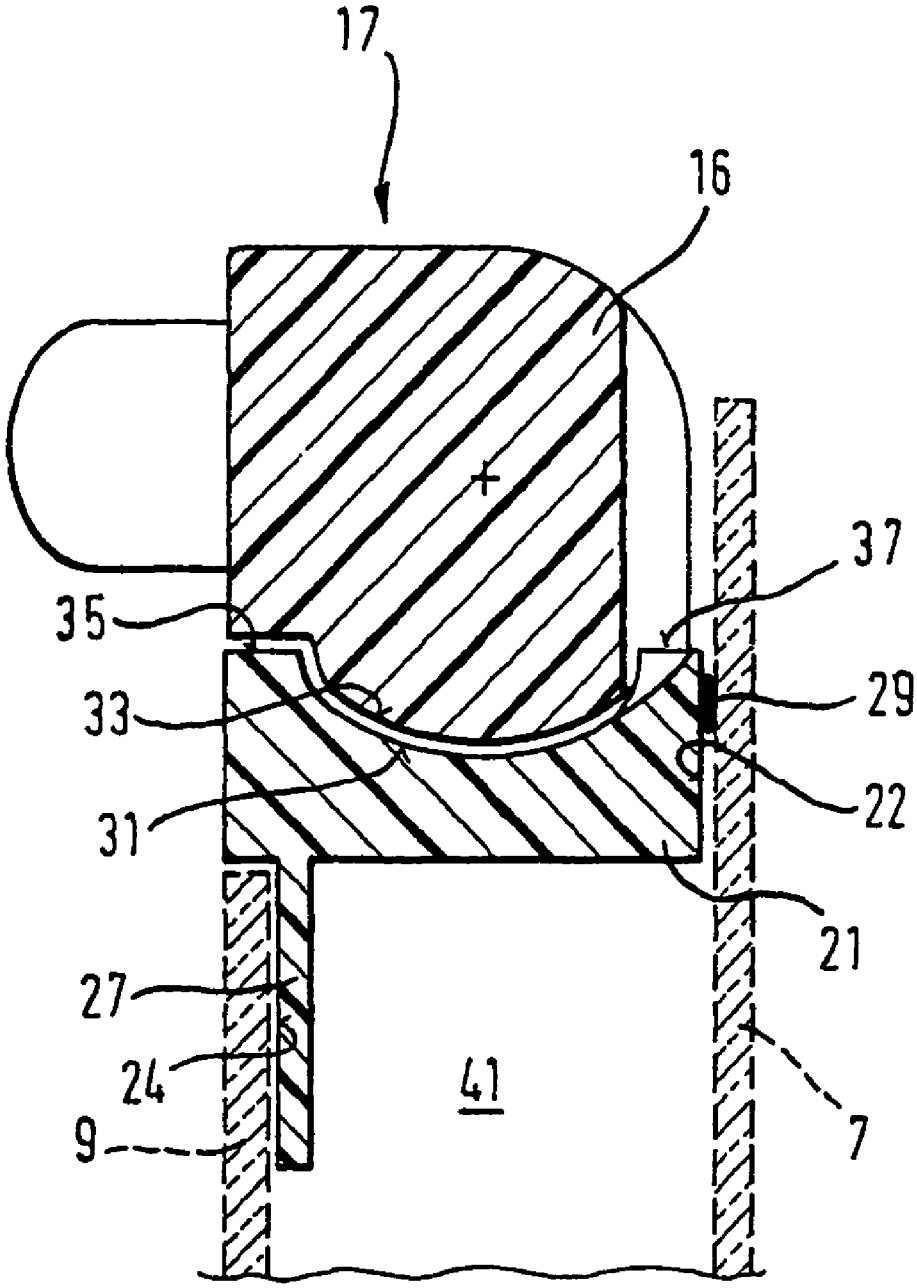
FIG. 3 is a fragmentary, side cross-sectional view of the handle of FIG. 2 along section line A—A.

Additional stiffening elements 27 are formed on the front side of the bearing housing 21. According to FIG. 3, the stiffening elements 27 are in contact with the outer door window 9. FIG. 3 shows a sectional illustration along the line A—A from FIG. 2, in which the door windows 7, 9 are indicated in dashed lines. Accordingly, the stiffening element 27 is in contact with the outer door window 9 while the inner door window 7 rests, with the interposition of a seal 29, against a contact surface 22 of the bearing housing 21. FIG. 3, furthermore, reveals that the bearing housing 21 has a supporting surface 31. The supporting surface 31 is disposed between the lateral pivot pins (journals) 19 and extends in the axial direction of the pivoting part 16 over virtually the entire length of the pivoting part 1. A corresponding mating surface 33 of the pivoting part 16 is in contact with the supporting surface 31. During the pivoting movement of the door handle 17, the pivoting part 16 thereof is, therefore, supported on the supporting surface 31. Furthermore, two stops 35, 37 that restrict and bound a pivoting region of the door handle 17 are formed on the bearing housing 21.

As illustrated in FIG. 2, the door handle 17 is assigned a tension spring 39 that pre-stresses the door handle 17 in a pivoting direction. The tension spring 39 is provided below the bearing housing 21 and extends in the longitudinal direction of the bearing housing 21. The tension spring 39 is suspended freely in the inner space 41 of the door that is formed between the door windows 7, 9. The freely suspended configuration of the tension spring 39 within the inner space 41 of the door makes it possible to achieve a free expansion and, therefore, low-wear loading of the tension spring 39.

Figure 4:
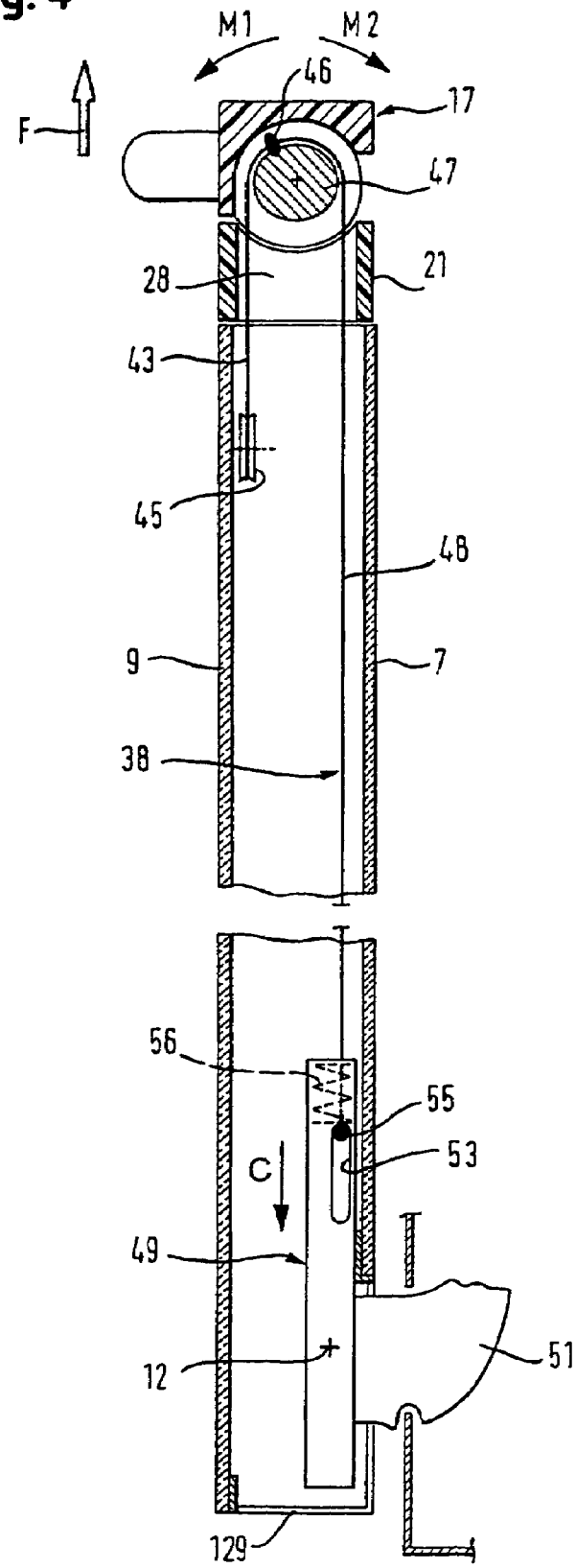
FIG. 4 is a fragmentary, side cross-sectional view of the door handle of FIG. 1 along section line B—B.

The two ends of the tension spring 39 are connected in each case through a first tension cable 43 to the pivoting part 16 to transmit a tension spring force to the pivoting part 16. The first tension cables 43 are guided through deflecting rollers 45, which are mounted rotatably on the stiffening elements 27, to radial cam plates 47. The radial cams 47 are connected on both sides in a rotationally fixed manner to the longitudinal ends of the pivoting part 16. Each of the first pulling cables 43 here is fixed on the circumference of the cam plate 47 at a fastening point 46. As a result, the tension spring 39 pre-stresses the door handle 17 against the first stop 35 and subjects the door handle 17 to a first torque M1 in a pivoting direction (FIG. 4). To protect against contamination, the radial cams 47 are disposed within lateral cutouts of the pivoting part 16. Covering sections 18 of the pivoting part 16 cover the cutouts on the end side.

A second tension cable 48 engages on the circumference of each of the radial cams 47. The second tension cable 48 is guided around the cam plate 47 in the direction counter to the first pulling cable 43 and is fixed on the circumference of the cam plate 47 at the fastening point 46. The first and second tension cables 43, 48 and the radial cams 47 form constituent parts of a control mechanism 38. The control mechanism 38 transmits a pivoting movement of the door 5 to the door handle 17, i.e., when the door 5 is pivoted in a first pivoting direction, the control mechanism 38 pivots the door handle 17 in a second pivoting direction, counter to the first pivoting direction. The construction and functioning of the control mechanism 38 are explained below with reference to FIG. 4.

FIG. 4 shows an upper and lower cutout of the door 5 in a sectional illustration along the line B—B from FIG. 1. The door 5 is disposed in a closed position. In the lower section of the door 5, a conventional door hinge 49 is disposed in the interior space 41 of the door. The door hinge 49 has a hinge part 51 projecting through the inside of the door, which is directed toward the cooking space 3; the hinge part 51 is inserted in a corresponding socket in the cooking appliance. As is known, the door hinge 49 has a weight-balancing mechanism that is indicated by a weight-balancing spring 56. During a pivoting of the door 5, the weight-balancing mechanism exerts a balancing force on the hinge part 51; the balancing force counteracts the weight of the door 5. A displacement movement of one of the ends of the weight-balancing spring 56 is achieved during the pivoting movement of the door 5. This lifting movement of the spring end is picked off by a hinge rod or tappet 55 guided in a longitudinal groove 53. The hinge rod 55 is connected to the abovedescribed pulling cable 48, which acts on the circumference of the cam plate 47. The tension cable 48, therefore, converts the rectilinear lifting movement of the hinge rod 55 into a rotational movement of the radial cam 47. The hinge rod 55, therefore, acts as a driving part of the control mechanism 38. If the door 5 is pivoted downward from its closed position, which is shown in FIG. 4, the hinge rod 55 moves in a rectilinear movement downward, in the direction of the arrow C that is shown, in the elongated hole or slot 53. The rectilinear movement of the hinge rod 55 is transmitted through the tension cable 48 to the radial cam 47. As a result, a second torque M2 that is directed counter to the first torque M1 is exerted on the door handle 17. The effect that can be achieved as a result is that the horizontal orientation of the door handle 17 that is shown in FIG. 4 is substantially retained regardless of the pivoting position of the door 5.

If an operator exerts an upwardly directed actuating force F on the door handle 17 shown in FIG. 4—for example, during transportation of the cooking appliance—the resultant pivoting movement of the pivoting part 16 of the door handle in the clockwise direction is absorbed by the tension spring 39. This prevents the pivoting movement of the door handle 17, which movement is directed in the clockwise direction of FIG. 4, from being transmitted to the control mechanism 38. The tension spring 39, accordingly, acts, as a safeguarding device that prevents damage to the control mechanism 38.

The magnitude of the spring force of the tension spring 39 and/or the torque M1 exerted thereby is based on a minimum value for the spring force of the tension spring 39. This minimum value corresponds approximately to the frictional forces that have to be overcome to restore the door handle 17 after an actuating force F is no longer exerted on the door handle 17. The tension spring 39 is dimensioned such that the abovementioned minimum value is approximately 10% to 20% of the spring force of the tension spring 39. The spring force of the tension spring 39 is, therefore, approximately five to ten times larger than this minimum value. When the door handle 17 is actuated incorrectly, for example, as a result of the upwardly directed actuating force F being exerted (see FIG. 4), damage to the control mechanism 38 is, thus, prevented. At the same time, the comparatively large spring force permits an ergonomically favorable operating feel during a normal opening or closing actuation of the door handle 17 by the operator.

Figure 5:
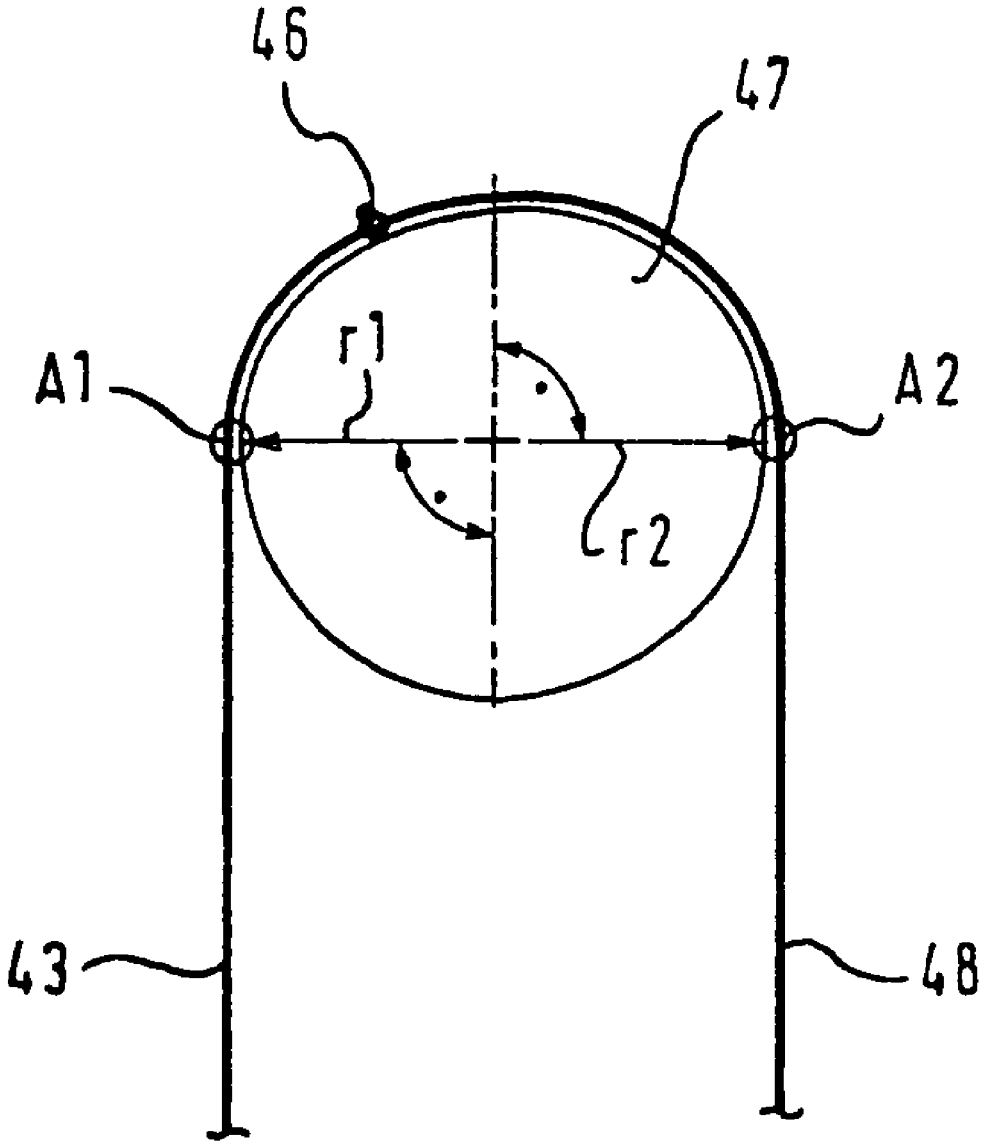
FIG. 5 is a diagrammatic, enlarged, cross-sectional view of a detail of the handle of FIG. 4.

The radius of the cam plate 47 is very important to ensure that the movement of the hinge rod 55 is transmitted to the door handle 17 in a correct transmission ratio. On one hand, the radius of the cam plate 47 determines the length of the lever arm and, thus, the magnitude of the torque by which the pulling cables 43, 48 act on the cam plate 47. On the other hand, the cam-plate radius defines the transmission ratio by which a drive movement of the control mechanism 38 is converted into a pivoting movement of the door handle 17. In FIG. 5, the lever-arm lengths r1, r2 of the cam plate 47, which lengths are associated with the first and the second tension cable 43, 48, are configured such that they differ in magnitude. FIG. 5 shows an enlarged illustration of the radial cam 47 from FIG. 4.

In FIG. 5, the points of action of the pulling cables 43 and 48 are designated A1 and A2. During an operation for opening the door 5, the point of action A1 of the pulling cable 43 moves through an angle of rotation of approximately 90° in the counterclockwise direction along the circumference of the cam plate 47. Over this angle of rotation, the lever arm length r1 is substantially constant. The torque M1 exerted on the door handle 17 is, therefore, constant during the pivoting movement of the door 5. At the same time, the engagement point A2 of the tension cable 48 moves through an angle of rotation section of approximately 90° in the counter-clockwise direction (with respect to FIG. 5) along the circumference of the radial cam 47. Over this angle of rotation, the lever arm length r2 is reduced during a pivoting movement of the door 5 from its closed position; that is to say, in the horizontal door position, the torque M2 exerted on the door handle 17 is the lowest possible. In the horizontal door position, the torque M2 counteracts a weight of the door 5; the weight of the door 5 keeps the door 5 stably in its horizontal position. The torque M2, which is reduced in the horizontal door position, is, therefore, not capable of compensating for the weight of the door. The stable position of the door in its horizontal position is, therefore, not adversely affected by the torque M2.

A radial cam 47 that is formed eccentrically enables the transmission ratio of the control mechanism 38 to be changed as a function of the pivoting position of the door 5. It is thus possible to compensate for drive losses of the control mechanism 38, which are produced, for example, at the beginning of a pivoting movement of the door as a result of expansion of the pulling cables 43, 48 or of play in the control mechanism 38.

Figure 6:
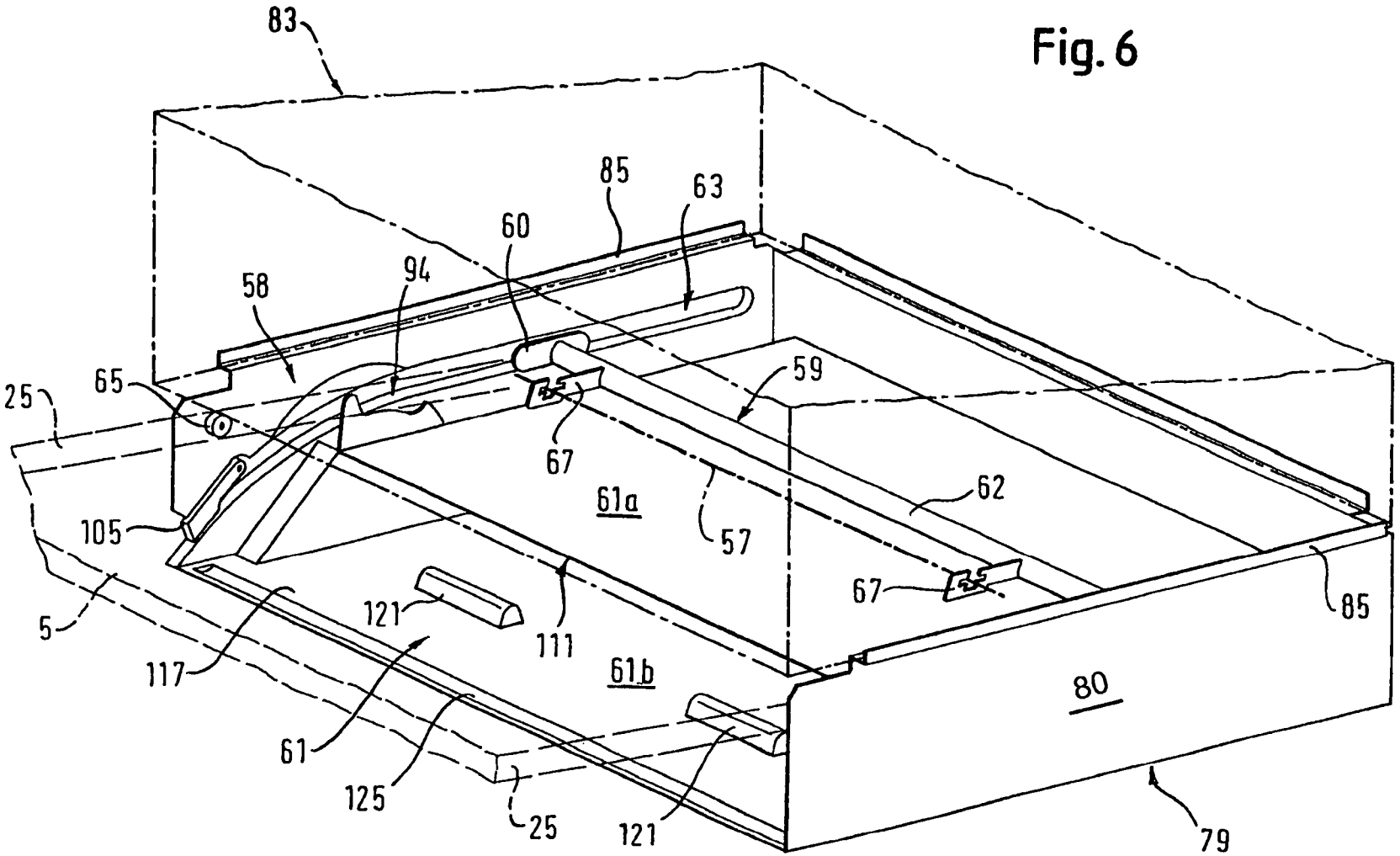
FIG. 6 is a fragmentary, perspective and partially hidden view of a second exemplary embodiment of a cooking appliance according to the invention.

FIG. 6 shows a cooking appliance according to a second exemplary embodiment of the present invention. The cooking appliance has a useful space module 83, which is indicated by a chain-dotted line and in which the cooking appliance muffle 3 (not illustrated) is disposed. A storage space module 79 is disposed below the useful space module 83. The storage space module 79 has a storage space 61 in which a guide system 58 for the door 5 is provided. The guide system 58 enables the cooking appliance door 5 (illustrated by dashed lines) to be displaced into the storage space module 79. According to FIG. 6, the storage space module 79 serves as a base or foundation on which the useful space module 83 is mounted. The storage space module 79 is configured as an upwardly open sheet-metal housing. Step-shaped abutment shoulders 85 are formed on the upper edge of the side walls 80 of the sheet-metal housing 79. The useful space module 83 rests on the contact shoulders 85 in a positionally correct manner, as indicated in FIG. 6. The operating and display elements 2, which are shown in FIG. 1, and an associated control unit are provided in the useful space module 83. The operating and display elements 2, here, together with the associated control unit, can function independently of the stowage-space module 79.

In contrast to the first exemplary embodiment, the driving movement for the control mechanism 38 is not produced by the conventional door hinge 49 that is shown in FIG. 4. On the contrary, the control mechanism 38 of the second exemplary embodiment has, as driving part, a rotary shaft 57. The rotary shaft 57 is operatively connected to a guide element 59 of the guide system 58.

Figure 7:
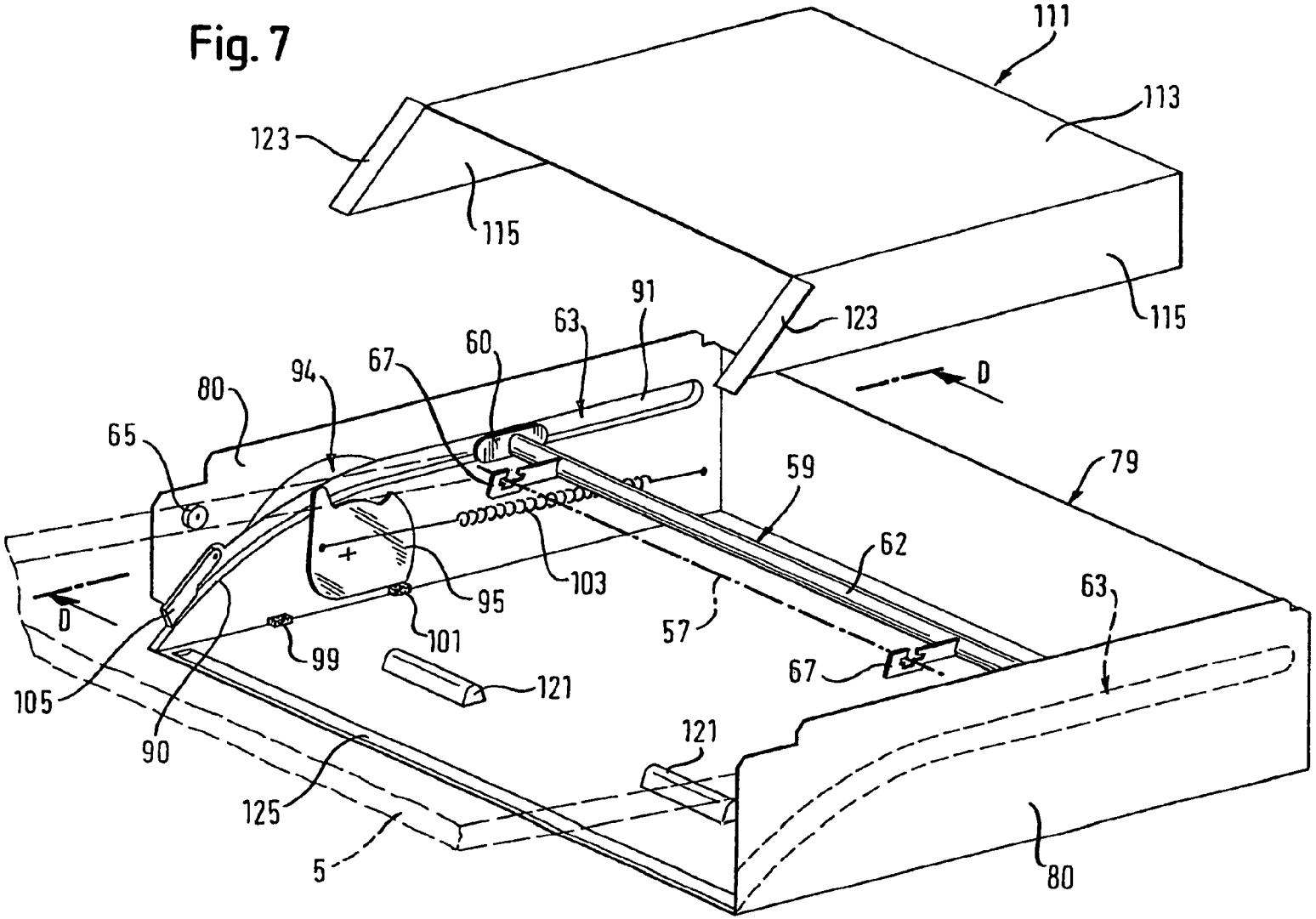
FIG. 7 is a fragmentary, perspective and partially hidden view of a storage space module of the cooking appliance of FIG. 6.

The construction and the functioning of the guide system 58 for the door 5 and the production of a drive movement for the control mechanism 38 is explained hereinbelow:

As illustrated in FIG. 6, the guide element 59 is part of the guide system 58, with the aid of which the door 5 is pushed, during an opening process, into the storage space 61 provided below the cooking space 3. FIGS. 6 and 7 reveal that the guide system 58 has slotted-guide tracks 63. The slotted-guide tracks 63 are formed in the two opposite side walls 80 of the storage space module 79. The opposite slotted-guide tracks 63 guide sliders 60 of the guide element 59 therein. The sliders 60 are welded to each other through a connecting rod 62. The guide element 59 is, therefore, guided in the opposite slotted-guide tracks 63 in the manner of a guide carriage. Between the two sliders 60, adjusting levers 67 are welded to the connecting rod 62. As illustrated in the enlarged perspective cutout of FIG. 8, the adjusting levers 67 are connected in a form-fitting manner to the rotary shaft 57 of the control mechanism 58. The rotary shaft 57 is indicated in FIGS. 6 and 7 by chain-dotted lines.

Figure 8:
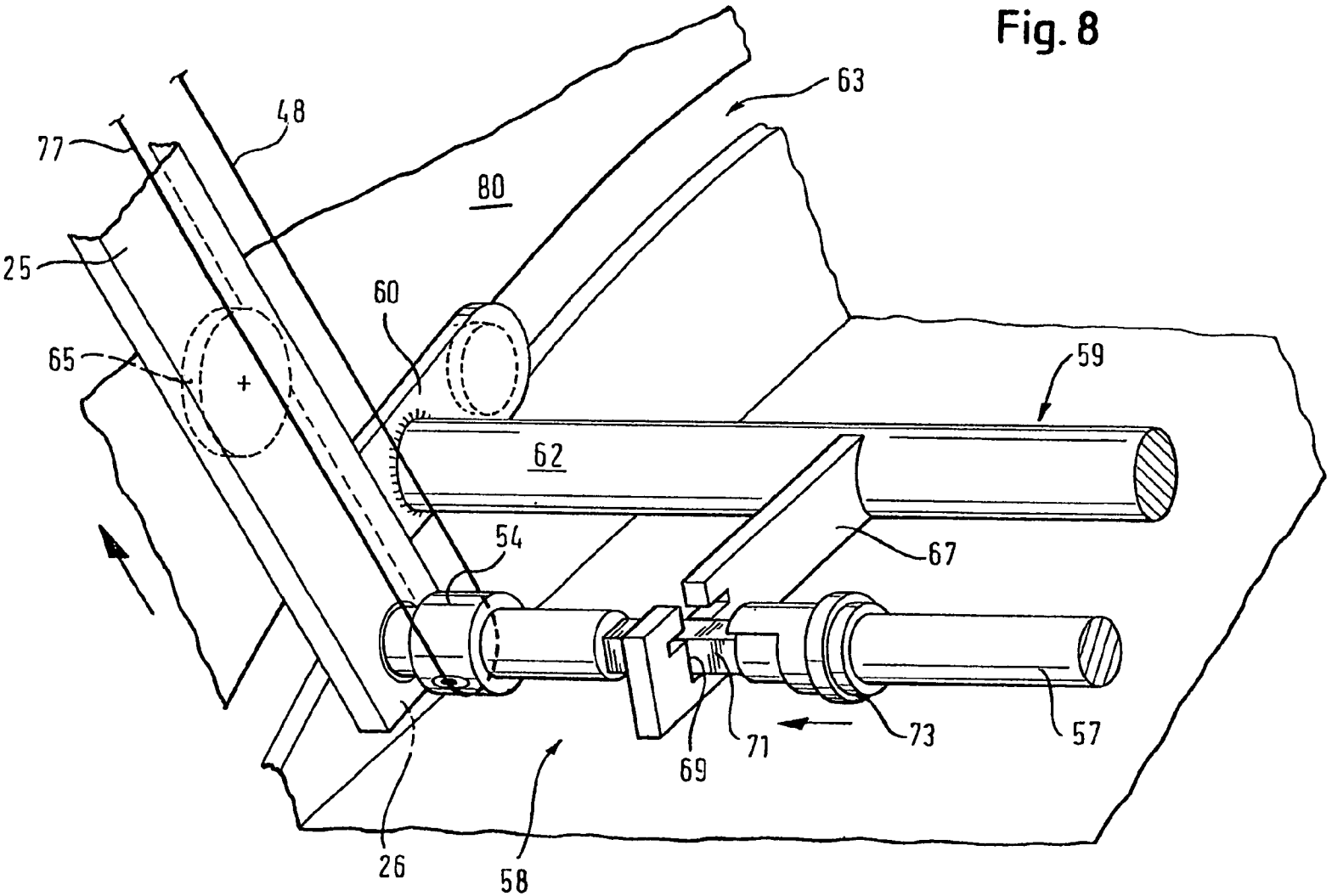
FIG. 8 is a fragmentary, enlarged, perspective view of a detail of the module of FIG. 7.

The above-mentioned form-fitting connection between the adjusting levers 67 of the guide carriage 59 and the rotary shaft 57 of the door 5 is illustrated in FIG. 8. The inner and outer door windows 7, 9 of the door 5 have been omitted from FIG. 8. Accordingly, the rotary shaft 57 is mounted rotatably in the opposite edge strips 25 of the door 5. For the form-fitting connection, the adjusting levers 67 of the guide carriage 59 each have a rectangular cutout 69 (FIG. 8). A corresponding, rectangular shape section 71 of the rotary shaft 57 is mounted in the cutout 69. The lateral edge strips 25 of the door 5 are provided in the outward direction in each case with a U-shaped groove that serves as a guide rail. In these guide rails 25, respective bearing rollers 65 are guided displaceably on both sides. The bearing rollers 65 are fastened to the side wall 80 of the storage space module 79. The U-shaped groove, which serves as a guide rail, is constructed on its lower end side with an open end 26. When the door is removed, as will be described at a later stage in the text, the housing-mounted bearing roller 65 can be released from the associated guide rail 25 by way of the open end 26.

Each of the opposite slotted-guide tracks 63 has a starting section 90 and a slide-in section 91. According to FIGS. 9A and 9C, an angle of inclination of the starting section 90 is approximately 45°. The starting section 90, furthermore, takes up approximately 30% of the entire length of the slotted-guide track 63 while the transition between the starting section 90 and the slide-in section 91 has a curved profile. The slide-in section 91 runs substantially in a horizontal plane. The bearing rollers 65, which are fixed on the housing, are disposed approximately level with the slide-in section 91 of the slotted-guide track 63.

Figure 9A:
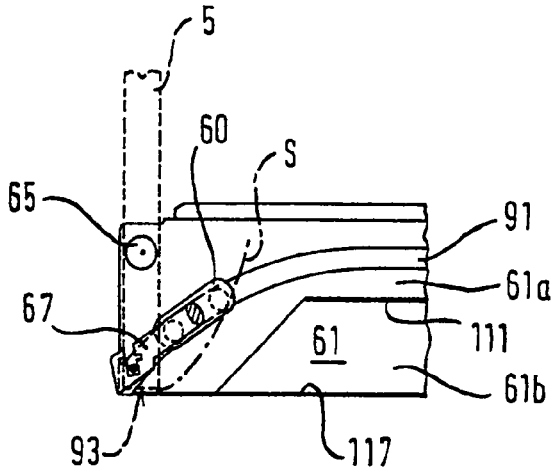
FIG. 9A is a fragmentary, side elevational and partially hidden view of a first part of an opening process of the mechanism of FIG. 8.
Figure 9B:
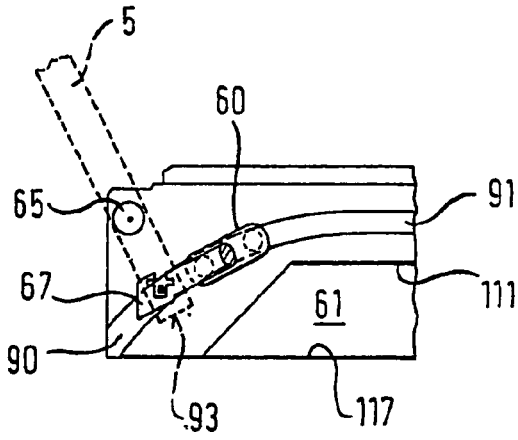
FIG. 9B is a fragmentary, side elevational and partially hidden view of a second part of an opening process of the mechanism of FIG. 8.
Figure 9C:
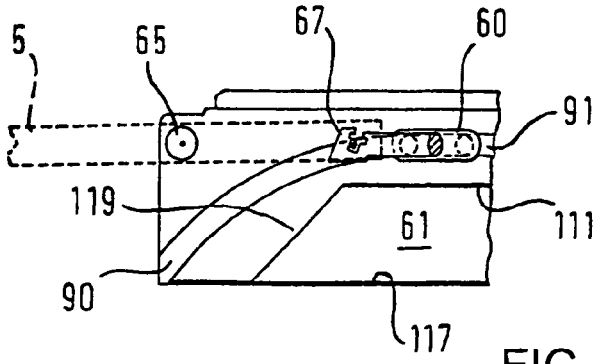
FIG. 9C is a fragmentary, side elevational and partially hidden view of a third part of an opening process of the mechanism of FIG. 8.

The course of movement of the guide carriage 59 of the door 5 in the slotted-guide tracks 63 is described with reference to FIGS. 9A to 9C. FIG. 9A shows the door 5 in its closed position. In the closed position, the sliders 60 of the guide carriage 59 are in the starting section 90 of the slotted-guide track 63. During an opening movement of the door 5 from its closed position shown in FIG. 10, the sliders 60 of the guide carriage 59 are initially displaced upward. As a result, the adjusting levers 67 of the guide carriage 59 lift the door 5 upward. With this lifting movement of the door 5, a lower end side 93 of the door 5, which side pivots into the storage space 61, is displaced, at the same time, upward away from a base 117 of the storage space module 79, as is revealed in FIG. 9B. As a result, a pivoting region S of the lower end side 93, which region protrudes into the storage space 61 and is indicated by a chain-dotted line, is reduced. After the guide carriage 59 is moved from the starting section 90 into the horizontal slide-in section 91 (FIG. 9C), the door 5 is in a horizontal plane, in which it can be slid into the storage space 61. During the pivoting movement of the door 5, a pivoting angle between the door 5 and the guide block 59 changes. Because the rotary shaft 57 of the control mechanism 38 is mounted in a form-fitting manner in the adjusting levers 67 of the guide slide 59, the change in the pivoting angle between the door 5 and the guide carriage 59 causes a rotation of the rotary shaft 57. That is to say, during the pivoting movement of the door 5, the rotary shaft 57 is inevitably rotated by the guide element 59.

Figure 10:
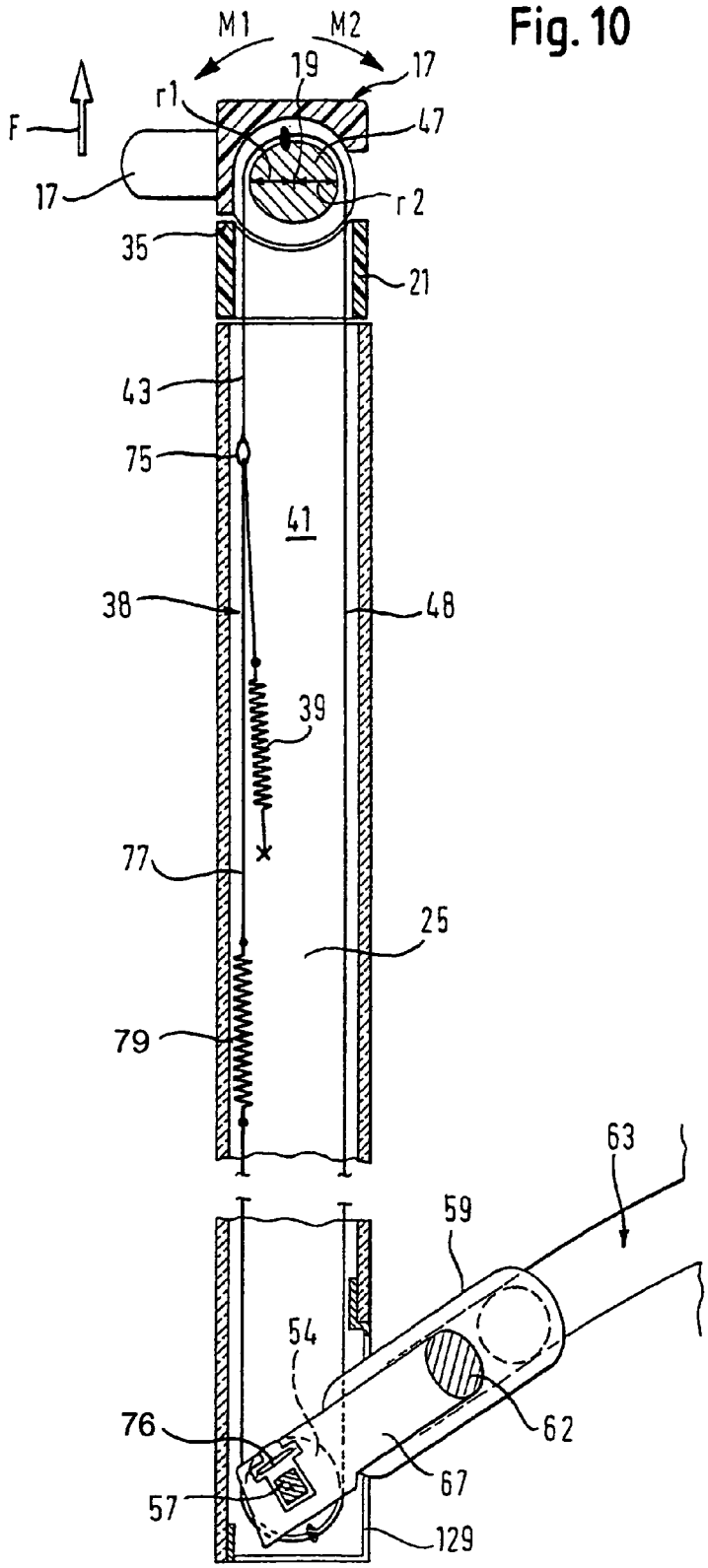
FIG. 10 shows a side sectional illustration of an upper and lower section of the door of the cooking appliance from FIG. 6.

The manner in which the control mechanism 38 transmits the inevitable rotation of the rotary shaft 57 to the door handle 17 is explained with reference to FIG. 10. FIG. 10 shows a side sectional view of the upper and lower section of the door 5 according to the second exemplary embodiment. This reveals that the adjusting lever 67 protrudes through an access opening 129 of the door 5 into the interior space 41 of the door and is connected in a form-fitting manner to the rotary shaft 57. As can be gathered from FIGS. 8 and 10, the rotary shaft 57 is configured with a driving drum 54, which is disposed in a rotationally fixed manner on the rotary shaft 57. The driving drum 54 is in engagement circumferentially with the tension cable 48. As in the first exemplary embodiment, the tension cable 48 is connected to the door handle 17.

During the pivoting movement of the door 5, a pivoting movement, therefore, arises between the guide carriage 59 and the door 5. As a result, the rotary shaft 57 is rotated inevitably. The rotational movement of the rotary shaft 57 is transmitted through the driving drum 54 to the tension cable 48. The tension cable 48 converts the rotational movement of the rotary shaft 57 into a rotational movement of the radial cam 47 and subjects the door handle to the second torque M2 , which is directed counter to the first torque M1, on the door handle 17. The door handle 17, therefore, retains its horizontal alignment regardless of the pivoting position of the door 5.

In contrast to FIG. 4 of the first exemplary embodiment, in FIG. 10, the first tension cables 43, which engage on both sides on the radial cams 47 of the pivoting part 16 of the door handle 17, are not connected to a common tension spring. Rather, according to FIG. 10, each of the first tension cables 43 is associated with a dedicated tension spring 39. The tension spring 39 is fastened at one end of the spring to the edge strip 25 of the door 5. The other end of the tension spring 39 is coupled to the tension cable 43 through a retaining eyelet 75. As a result, the door handle 17 is subjected to the first torque M1 in the counterclockwise direction.

The control mechanism 38 shown in FIG. 10 has a third tension cable 77. The third tension cable 77 is, on one hand, in circumferential engagement with the driving drum 54 of the rotary shaft 57 and is guided about the driving drum 54 in the opposite direction to the second tension cable 48. On the other hand, the third tension cable 77 is connected to the retaining eyelet 75 of the first tension cable 43. The first, second, and third tension cables 43, 48, 77 of the control mechanism 38 form a closed cable control that envelops the radial cam 47 and the driving drum 54 to transmit the rotational movement to the door handle 17.

To tighten the closed cable control 43, 48, 77, a tightening spring 79 is integrated in the third tension cable 77. The tightening spring 79 serves to tighten the closed cable control 43, 48, 77. In addition, the tightening spring 79 increases the torque M1 that is exerted by the tension spring 39 on the door handle 17. Therefore, both the tightening spring 79 and the tension spring 39 are present for exerting the torque M1. It is, therefore, advantageously possible for use to be made of two comparatively small springs that take up only a small amount of space in the limited inner space 41 of the door.

If the operator, for example, during transportation of the cooking appliance 1, exerts an upwardly directed actuating force F on the door handle 17 shown in FIG. 4, the resultant pivoting movement of the pivoting part 16 of the door handle in the clockwise direction is absorbed by the tension spring 39 and by the tightening spring 79. The resultant pivoting movement of the pivoting part 16 is, therefore, not transmitted from the door handle 17 to the control mechanism 38. As a result, damage to the control mechanism 38 is prevented.

The dimensioning of the spring force of the tension springs 39, 79 depend on the minimum value for the spring force, which value is specified in conjunction with FIG. 4.

Furthermore, the tension cables 43, 48, 77 can be provided with adjusting elements for adjusting a tensile stressing. By the adjusting elements, the tension cables provided on both sides of the door sides can be acted upon with an identical tensile stress. As a result, a synchronous operation of the two control mechanisms 38 is achieved.

A weight-balancing configuration 94 for the door 5 of the second exemplary embodiment is described below with reference to FIGS. 7, 11, and 12. During a movement of the door 5, the weight-balancing configuration 94 exerts a balancing force on the door 5, which force acts counter to the weight of the door 5. The weight of the door 5 is, therefore, not absorbed by the operator during a door movement, but, rather, by the weight-balancing configuration 94.

FIG. 7 shows, in a perspective view, the storage space module 79, of which a space divider 111 (described later on) is illustrated separately. On each of the opposite side walls 80, the weight-balancing configuration 94 has a pivoting lever 95. The pivoting lever 95 is mounted pivotally on the opposite side walls 80 through a lever spindle 97. FIG. 11 shows one of the side walls 80 in an enlarged side elevational view along the line D—D from FIG. 7. Accordingly, the pivoting lever 95 protrudes into the starting section 90 of the slotted-guide track 63 and is in engagement with the slider 60 of the guide carriage 59. A pivoting region of the pivoting lever 95 is configured such that the pivoting lever 95 is in engagement with the slider 60 of the guide carriage 59 only in the region of the starting section 90. By contrast, in the horizontal section 91, the pivoting lever 95 is disengaged from the slider 60 of the guide carriage 59. The pivoting lever 95 is connected to a tension spring 103. The tension spring 103 is fastened to the side wall 80. In FIG. 11, the tension spring 103 pre-stresses the pivoting lever 95 in the counter-clockwise direction.

Figure 11:
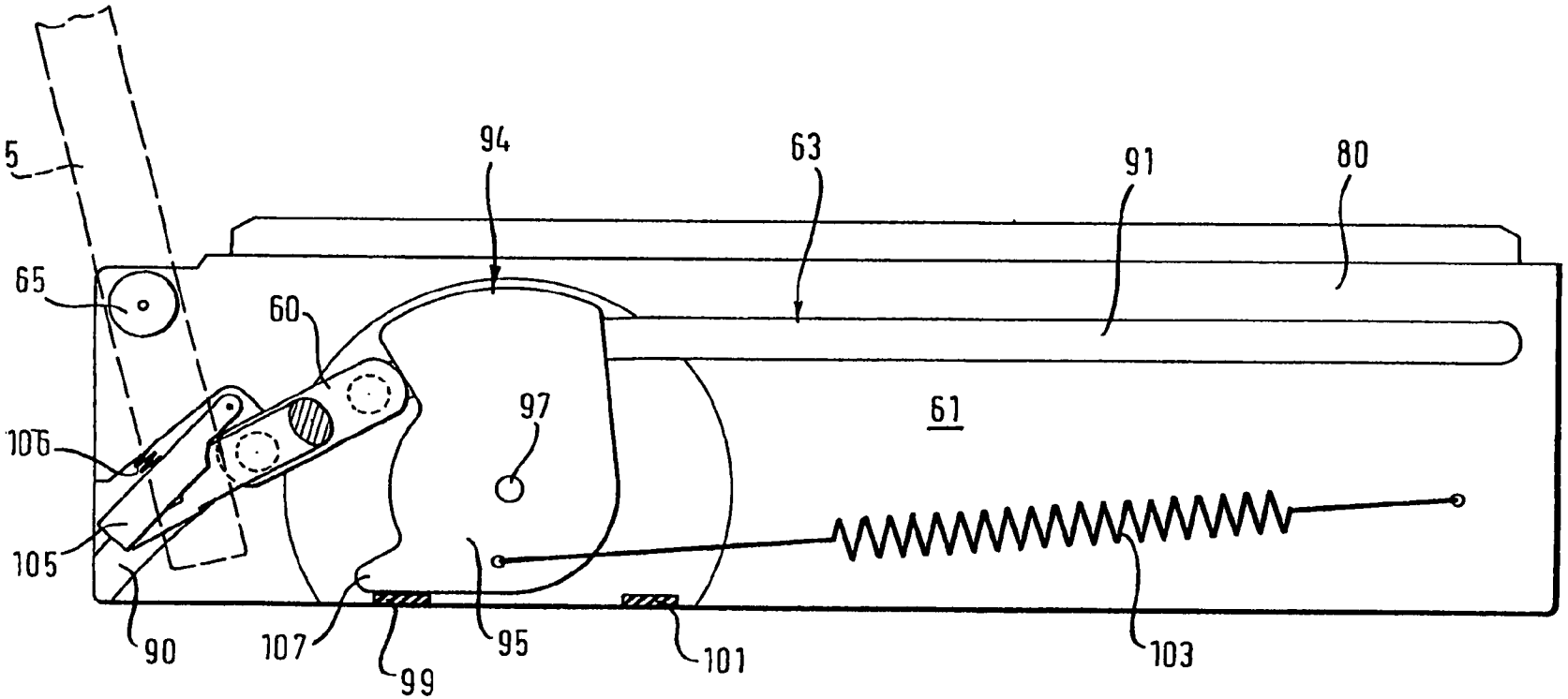
FIG. 11 is a side elevational view of the mechanisms of FIGS. 7 and 8 along line D—D in FIG. 7 in a first position.

When the door 5, which is illustrated by dashed lines in FIG. 11, is pivoted from its closed position downward into the horizontal position, the slider 60 runs from the starting section 90 into the horizontal section 91 of the slotted-guide track 63. During this movement, the slider 60 of the guide slide 59 presses against the spring-pre-stressed pivoting lever 95. The pivoting lever 95, therefore, subjects the sliding component 60 to a balancing force. The balancing force acts counter to the weight of the door 5.

As illustrated in FIG. 11, the pivoting lever 95 is pressed by the spring 103 against a first end stop 99, which is formed by a rubber support. In the position shown in FIG. 11, the pivoting lever 95 permits an initial movement of the slider 60 of the guide carriage 59 out of the closed position of the door 5. During this initial movement, the slider 60 does not engage with the pivoting lever 95. According to FIG. 11, the slider 60 comes into contact with the pivoting lever 95 only at a pivoting angle of the door 5 of approximately 20°. This simplifies the initial movement of the door 5 out of its closed position for the operator. Moreover, the pre-stressed pivoting lever 95 according to FIG. 11 acts as a stop against which the slider 60 of the guide carriage 59 strikes during the opening movement of the door 5. A certain pivoting position of the door 5 is, thus, signaled to the user. In the present case, this pivoting position corresponds to a removal position (described later on), in which a simple removal of the door 5 from the guide system 58 is made possible.

Furthermore, the weight-compensating configuration 94 has a pivotally mounted retaining element 105 that is pre-stressed by a spring 106. During the previously described initial movement of the door 5, the spring-pre-stressed retaining element 105 presses the slider 60 of the guide carriage 59 in the direction of the pivoting lever 95. As a result, the door 5 is retained stably in the removal position shown in FIG. 11.

Figure 12:
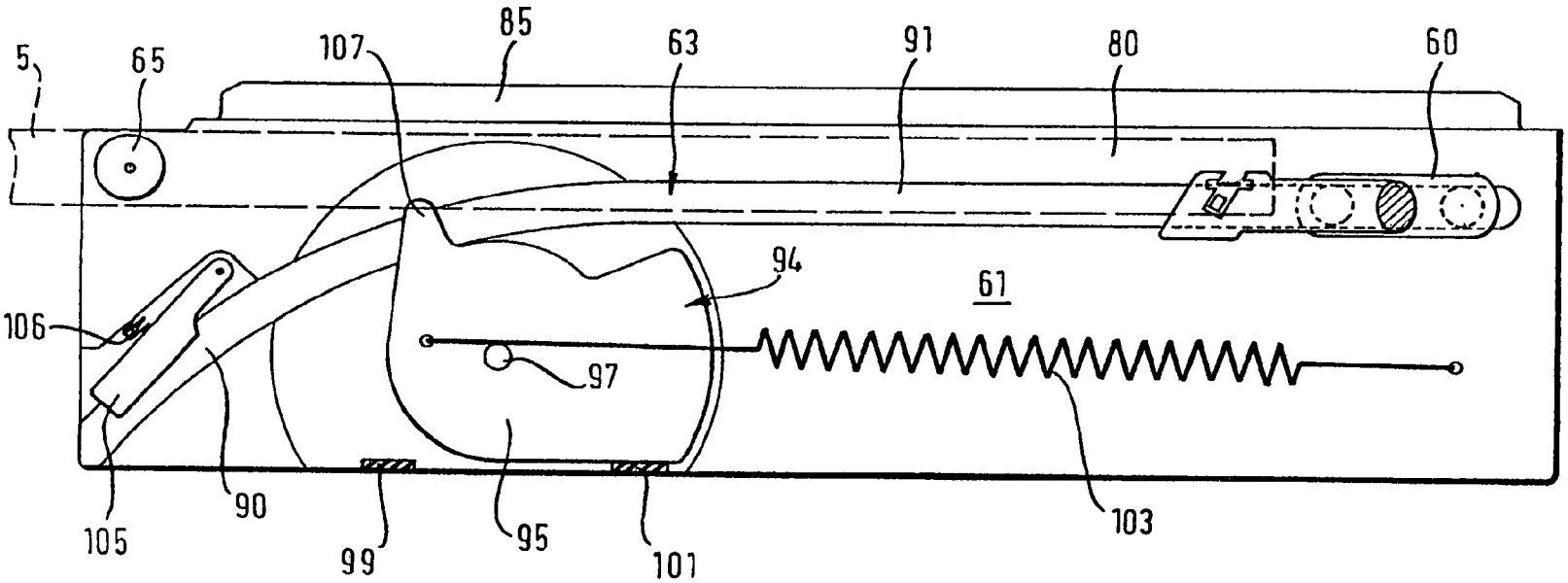
FIG. 12 is a side elevational view of the mechanism of FIG. 11 in a second position.

FIG. 12 shows the door 5 mounted horizontally and slid into the storage space 61. The slider 60 of the guide carriage 59 of the door 5 is in the horizontal slide-in section 91 of the slotted-guide track 63. During the movement of the slider 60 in the region of the slide-in section 91 of the slotted-guide track 63, the pivoting lever 95 is disengaged from the slider 60. The pivoting lever 95, therefore, does not exert any balancing force on the door 5. While the slider 60 runs in the slide-in section 91 of the slotted-guide track 63, the pivoting lever 95 is in the clockwise direction, by the spring 103, against a second end stop 101, which is, likewise, formed by a rubber support.

The pivoting lever 95 has a driver 107. The driver 107 of the pivoting lever 95 protrudes, in FIG. 12, into the slotted-guide track 63. According to FIG. 12, the slider 60 has been displaced from the starting section 90 into the slide-in section 91 of the slotted-guide track 63. The adjusting lever 95 is pre-stressed against the second end stop 101 and is in a holding position. When the door 5 is displaced out of the storage space 61, the slider 60 comes into engagement with the driver 107 of the pivoting lever 95. As a result, the pivoting lever 95 is brought out of its holding position and comes, once again, into a pressure contact with the slider 60 of the guide carriage 59. As a result, the pivoting lever 95 can, once again, exert the compensating force on the guide carriage 59 during a pivoting movement of the door 5.

Figure 13:
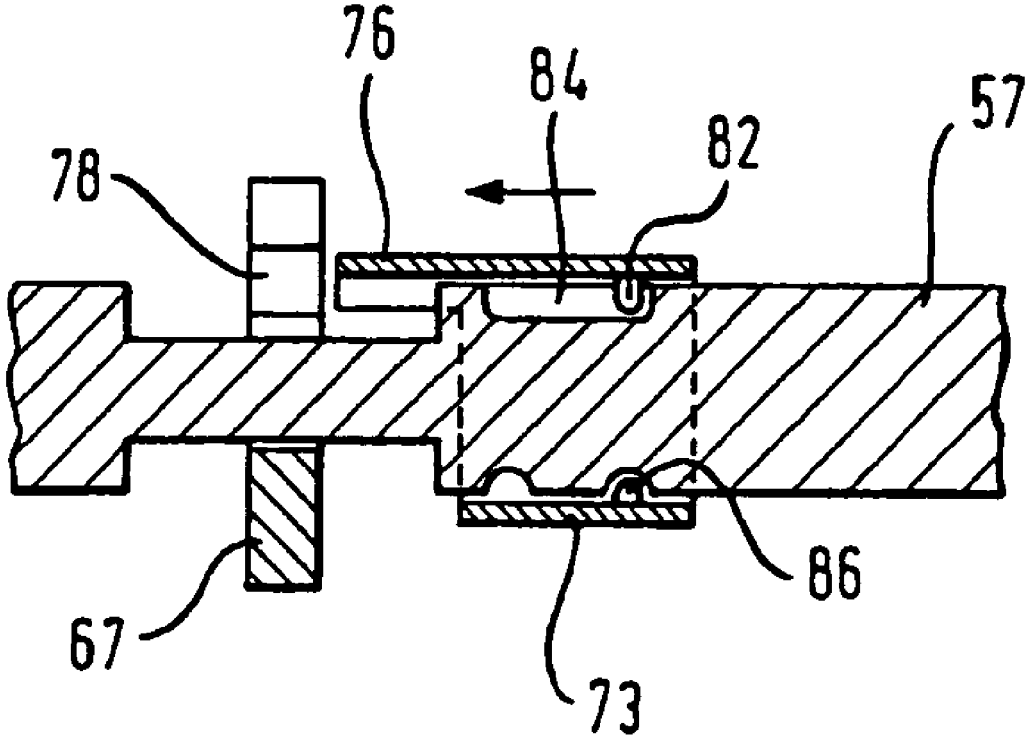
FIG. 13 is a fragmentary, enlarged, cross-sectional view of a portion of the module of FIG. 8 along section line C—C.

The releasable mounting of the door 5 on the guide system 58 is explained below with reference to FIG. 8. Due to the releasable mounting of the door 5 in the guide system 58, the door 5 can easily be removed for cleaning. As already described with reference to FIG. 8, the adjusting levers 67 have a rectangular cutout 69. The corresponding rectangular shape section 71 of the rotary shaft 57 is mounted in the rectangular cutout 69. This produces a form-fitting connection between the guide carriage 59 and the rotary shaft 57. A locking element 73 that, according to FIGS. 8 and 13, is mounted on the rotary shaft 57 is explained below. The locking element 73 can be displaced between a locking position and a release position. In the release position, the locking element 73 releases the mounting of the rotary shaft 57 in the adjusting lever 67. In a locking position of the locking element 73, the rotary shaft 57 is connected non-releasably to the adjusting lever 67.

According to FIG. 8, the catch element 73 has a bearing sleeve that is mounted such that it can be displaced in the axial direction of the rotary shaft 57. A protrusion 76 is formed on one end side of the bearing sleeve. The protrusion 76 projects, in FIG. 8, in the direction of a cutout 78 provided in the actuating lever 67. In the release position shown in FIG. 8, the protrusion 76 of the catch element 73 does not engage with the cutout 78 of the actuating lever 67. Raising the door 5 in an arrow direction Z, thus allows the rotary shaft 57 to be released from the guide carriage 59.

According to FIG. 13, the bearing sleeve of the catch element 73 has a guide pin 82. The guide pin 82 is guided between the locking position and the release position in a corresponding longitudinal groove 84 of the rotary shaft 57. The configuration ensures that the protrusion 76 of the catch element 73 can be pushed in a precisely positioned manner into the cutout 78 of the actuating lever 67. In addition, the bearing sleeve is formed with a latching protrusion 86. The latching protrusion 86 latches into corresponding cutouts of the rotary shaft 57 both in the release position and the locking position. The catch element 73 is, thus, secured in the locking position and release position. Accidental displacement of the catch element 73 is prevented in such a configuration.

As has already been described with reference to FIG. 11, the door 5 is kept stable in the removal position between the retaining element 105 and the actuating lever 95 over a pivoting angle of approximately 20° following its closed position. In this removal position, the rectangular cutout 69 of the actuating lever 67 is open in the vertically upward direction. The door 5 can, thus, be raised vertically upward in an ergonomically favorable manner for removal purposes without any skewing occurring between the shaped portion 71 of the rotary shaft 57 and the rectangular cutout 69 of the actuating lever 67. At the same time, when the door 5 is removed, the housing-mounted bearing rollers 65 can readily be guided through the open ends 26 of the lateral guide rails 25 of the door 5.

With the door 5 removed, the rotary shaft 57, rather than being positively guided by the guide carriage 59, can be rotated freely. On account of the freely rotatable rotary shaft 57, the tension spring 79 shown in FIG. 10 no longer has any effect on the magnitude of the torque M1 by which the door 5 is pressed against the first stop 35. With the door 5 removed, the magnitude of the torque M1 is, thus, determined solely by the spring force to which the pulling cable 43 is subjected by the tension spring 39.

The space divider 111 that is mentioned in conjunction with FIG. 7 is explained in the following text. As emerges, in particular, from FIG. 6, the space divider 111 is disposed in the storage space module 79. The space divider 111 divides the storage space 61 into a first storage space 61*a* and a second storage space 61*b*. The space divider 111 has a horizontal intermediate base 113 and side walls 115. The door 5 can be displaced into the first storage space 61*a*. The space divider 111 also separates the guide system 58, which is formed from the slotted-guide track 62 and guide carriage 59, and the weight-balancing configuration 94 from the second storage space 61*b*. Baking sheets or other accessories may be stored in the second storage space 61*b*.

As emerges from FIGS. 9A to 9C, the space divider 111 is disposed below the starting section 90 and the slide-in section 91 of the slotted-guide track 63. The intermediate base 113 together with the side walls 115 and a housing base 117 form an access opening 119. The latter is disposed spaced apart from the pivoting region S (indicated by a chain-dotted line) of the lower end side 93 of the door 5. Display elements 121 (FIGS. 7 and 8) are provided in the region of the access opening 119 of the second storage space 61*b*. The display elements 121 are configured as cams or protuberances that are fastened to the base 117 of the storage space 61. The display elements 121 indicate to the operator a maximum permissible length for objects that can be stored in the second storage space 61*b* without protruding into the pivoting region S of the lower end side 93 of the door 5. Appliance front-side panels 123 are formed on the side walls 115 of the space divider 111 (FIG. 7). The panels 123 serve for concealing the first storage space 61*a* from view. In addition, a collecting or drip channel 125 is provided in the housing base 117, in the region of the appliance front-side access opening 119, to keep the second storage space 61*b* free from contaminants, for example, dripping condensation water.

Figure 14A:
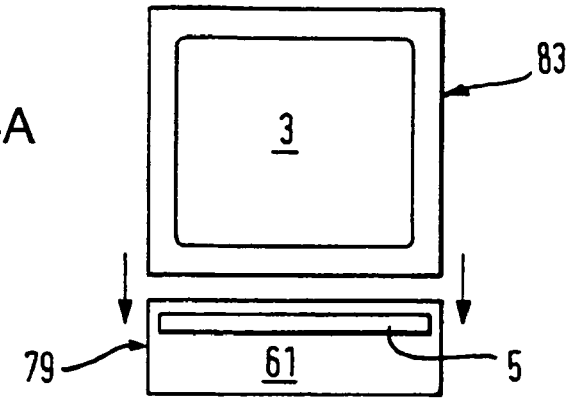
FIG. 14A is a diagrammatic front elevational view of a first embodiment of an assembly of the household appliance according to the invention.
Figure 14B:
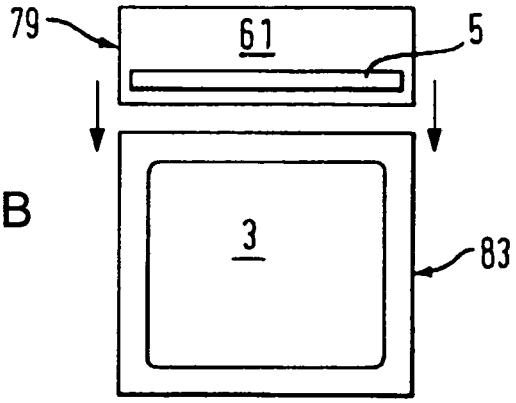
FIG. 14B is a diagrammatic front elevational view of a second embodiment of an assembly of the household appliance according to the invention.
Figure 14C:
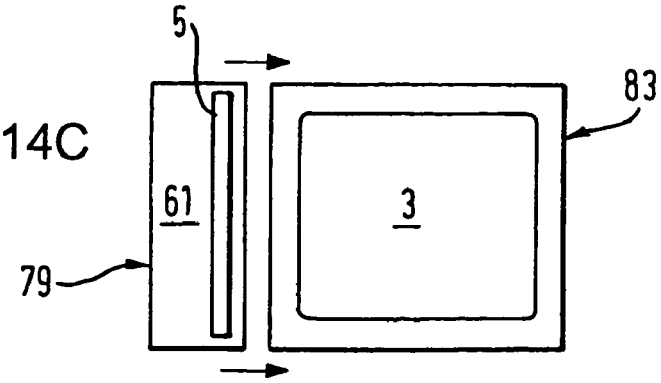
FIG. 14C is a diagrammatic front elevational view of a third embodiment of an assembly of the household appliance according to the invention.

FIGS. 14A to 14C illustrate schematic views of different variants of the household appliance according to the invention.

FIG. 14A shows the working-space module 83 and the stowage-space module 79 separately from one another. The construction and the functioning of the two modules 79, 83 corresponds to that of the preceding figures. The stowage-space module 79 and the working-space module 83, in the first instance, are produced independently of one another as separate structure units. The stowage-space module 79 and the working-space module 83 are, then, joined together in an assembly step to form the household appliance. According to FIG. 14A, the stowage-space module 79 serves as a pedestal on which the working-space module 83 is positioned in the direction of the arrows in FIG. 14A.

In contrast to FIG. 14A, the stowage-space module 79 in FIG. 14B is disposed above the working-space module 83. The door 5 can, thus, be displaced upward into the stowage space 61 of the stowage-space module 79. In FIG. 14C, the stowage-space module 79 is disposed on edge. The on-edge stowage-space module 79 is fastened, according to FIG. 14C, on one side of the working-space module 83. The door 5 can, thus, be displaced into the stowage space 79 disposed laterally on the working-space module 83.

Figure 15:
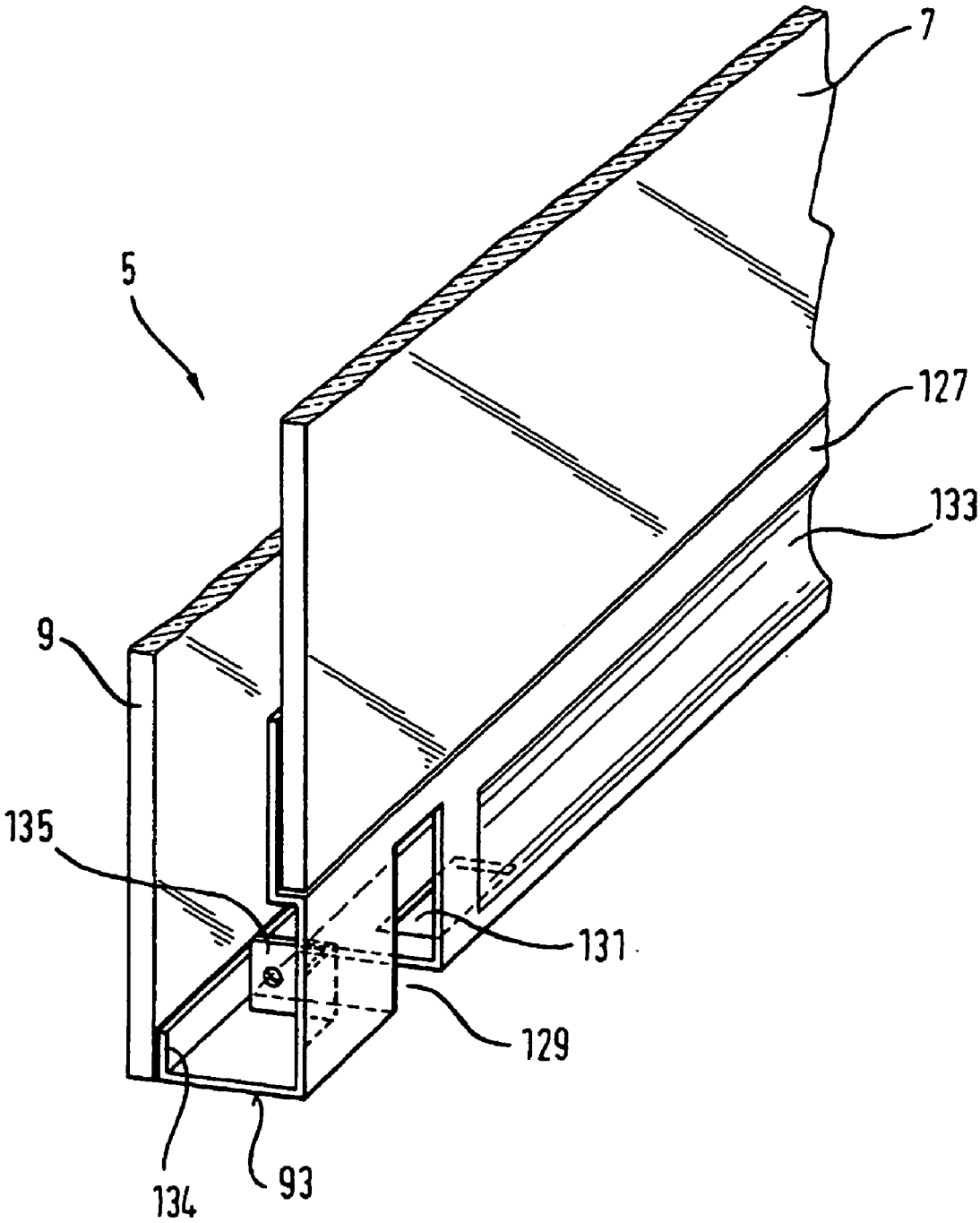
FIG. 15 is a fragmentary, enlarged, perspective view a bottom part of an embodiment of door according to the invention.

FIG. 15 gives a perspective illustration of part of an underside of the door 5. Accordingly, a sheet-metal element 127 is adhesively bonded to the inner door panel 7. Part of the inside of the door 5, which is directed toward the cooking space 3, is, thus, formed by the sheet-metal element 127. The sheet-metal element 127 has an extension portion that extends the inner door panel 7 to the bottom end side 93 of the door 5. Furthermore, the sheet-metal element 127 is bent at right angles to form the bottom end side 93 of the door 5. An abutment surface 134 is formed at the end of the bent part of the sheet-metal element 127. The distance between the outer door panel 9 and the inner door panel 7 is defined by the abutment surface 134.

Furthermore, a through-passage opening 129 is formed in the extension portion of the sheet-metal element 127. Projecting through the through-passage opening 129 is the actuating lever 67 of the guide carriage 59, which engages with the rotary shaft 57 disposed in the door interior 41 (FIG. 8). As an alternative, the hinge part 51 of the door hinge 49 of the first exemplary embodiment (illustrated in FIG. 4) can project through the through-passage opening 129. The through-passage opening 129, in addition to extending in the plane of the inside of the door, also extends in the plane of the bottom end side 93 of the door 5.

Further installation or operating openings may be provided in the sheet-metal element 127. For example, according to FIG. 15, an operating opening 131 is provided on the bottom end side 93 of the door 5. The operating opening 131 gives the user access to the catch element 73, which is disposed in an adjustable manner on the rotary shaft 57. The catch element 73 can, thus, easily be adjusted between the locking position and the release position. Furthermore, a collecting channel 133, for collecting dripping condensation liquid, is stamped in the sheet-metal element 127. If the door 5 is, thus, disposed horizontally in the stowage space 61, condensation located on the inside of the door collects in the collecting channel 133. The sheet-metal element 127 additionally has angled carriers 135 that serve for fastening the inner door panel 7 on the border strips 25 of the door. Through the angled carriers 135, the inner door panel 7 can easily be fastened on the border strips 25 of the door, for example, by a screw connection.

Figure 16:
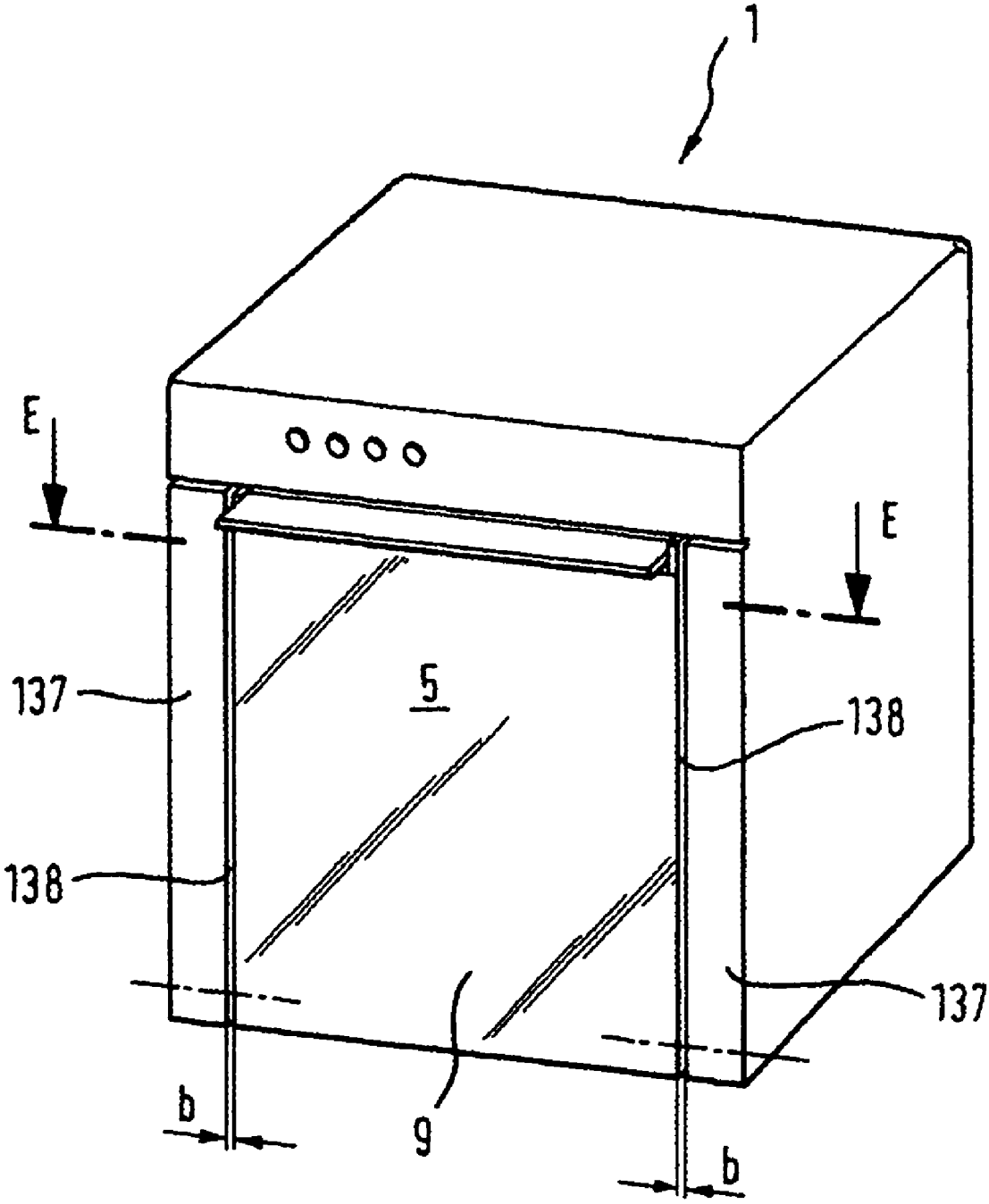
FIG. 16 is a perspective view of a cooking appliance according to the invention with the door in a closed position.
Figure 17:
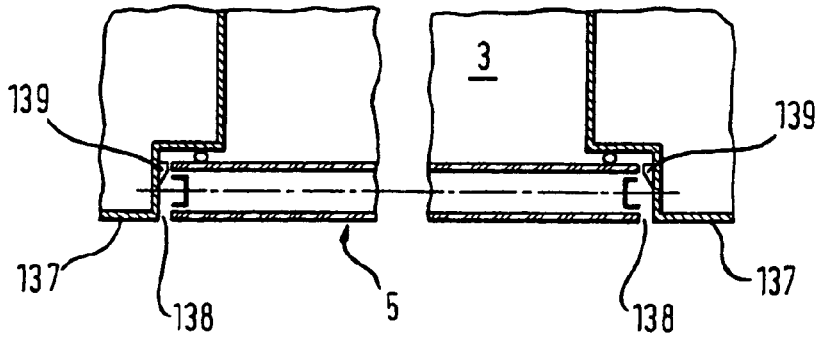
FIG. 17 is a fragmentary, enlarged, cross-sectional view of a portion of the appliance of FIG. 16 along section line E—E.

Spacers 139 by which the door 5 can be disposed correctly its closed position are described hereinbelow. FIG. 16 shows the cooking appliance 1 with its door 5 disposed in its closed position. Border strips 137 of the cooking appliance are disposed on both sides of the door 5. The border strips 137 are spaced apart from the door 5 through a gap 138. FIG. 17 shows a view in section along line E—E from FIG. 16. It can be seen from this view that spacers 139 are provided between the lateral peripheral edges of the inner door panel 7 and the respectively opposite border strips 137. The spacers 139 are formed from plastic and are fastened, on the housing side, on the border strips 137. In the closed position of the door 5, the spacers 139 define a gap width b between the door 5 and the border strip 137. For visual reasons, it is preferred if the spacers 139 retain the door 5 in a centered manner between the border strips 137.

Figure 18:
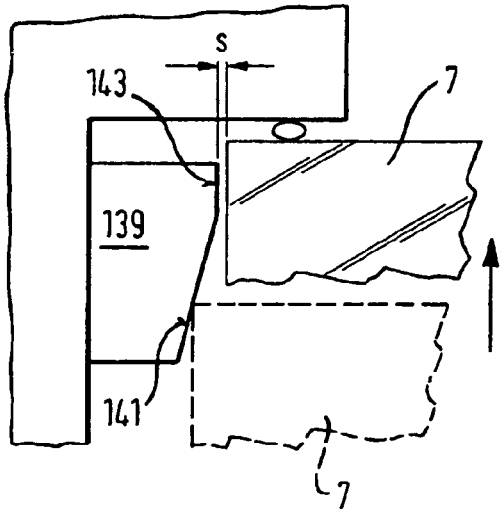
FIG. 18 is a fragmentary, enlarged, cross-sectional view of a first embodiment of a detail of the portion of FIG. 17.

The spacer 139 illustrated in FIG. 18 has a run-on slope 141 and a centering portion 143. The run-on slope 141 guides the door 5, during a closing movement, into the closing position, in which the visually favorable gap width b is achieved. The centering portion 143 follows after the run-on slope 141 in the closing direction of the door 5. In the closed position of the door 5, the centering portions 143 of the opposite spacers 139 each form lateral stops for the opposite peripheral edges of the inner door panel 7. As is shown in the enlarged detail from FIG. 18, the peripheral edges of the inner door panel 7 are disposed with a small amount of play s of approximately 1 mm between the centering portions 143 of the spacers 139 and the opposite peripheral edge of the inner door panel 7.

Figure 19:
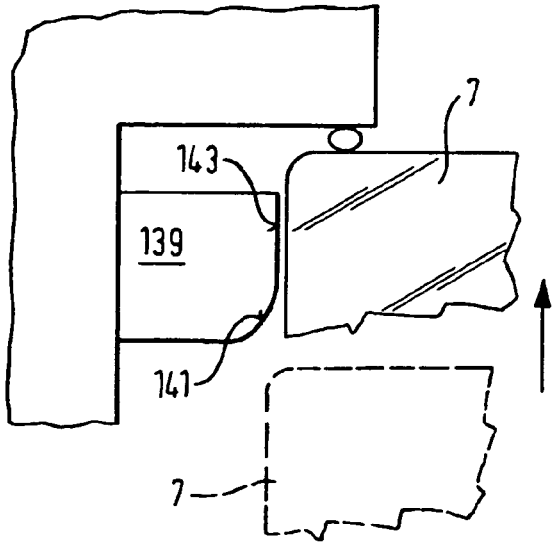
FIG. 19 a fragmentary, enlarged, cross-sectional view of a second embodiment of a detail of the portion of FIG. 17.

FIG. 19 shows a modification of the above-described spacer 139. Accordingly, the run-on slope 141 is of convexly curved formation and merges into the centering portion 143 without any transition edges. The opposite peripheral edge of the inner door panel 7 is, likewise, rounded. During the closing movement of the door 5 in the direction of the arrow in FIG. 19, the door 5 is, thus, positioned particularly smoothly between the centering portions 139.

The spacers 139 make it possible to mount the guide carriage 59 with axial play in the sliding tracks 63. The axial play ensures smooth-running displacement of the guide carriage 59 in the sliding tracks 63. On the other hand, the spacers 139 ensure that the door 5—despite the axial play—is positioned correctly in its closed position.

Figure 20:
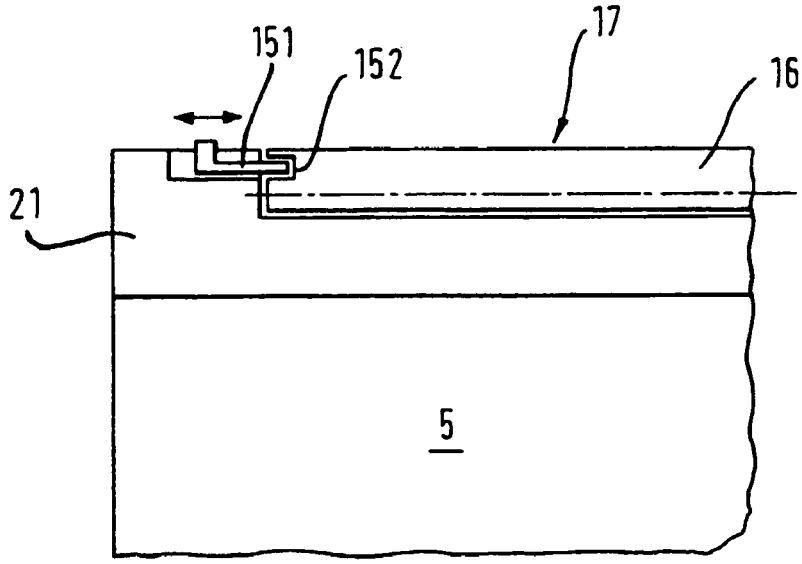
FIG. 20 a fragmentary, side elevational view of a third embodiment of a top portion of the door according to the invention.

A top portion of the cooking appliance door 5 according to the third exemplary embodiment is indicated schematically in FIG. 20. The bearing housing 21 and the door handle 17 mounted therein are configured in accordance with FIG. 2. Additionally, a blocking element 151 is secured in the bearing housing 21. The blocking element 151 can be displaced in the longitudinal direction of the bearing housing 21. FIG. 20 shows the blocking element 151 in its blocking position, in which it projects into a corresponding cutout 152 provided in the pivoting part 16 of the door handle 17. In the blocking position, the blocking element 151 prevents the door handle 17 from pivoting in relation to its bearing housing 21, that is say, the door handle 17 is rotationally fixed in relation to the bearing housing 21. If the user, thus, subjects the door handle 17 to an upwardly directed force, for example, during transportation of the cooker, transmission of a pivoting movement from the door handle 17 to the control mechanism 38 and, thus, possible damage to the control mechanism 38 are, therefore, prevented.

Figure 21:
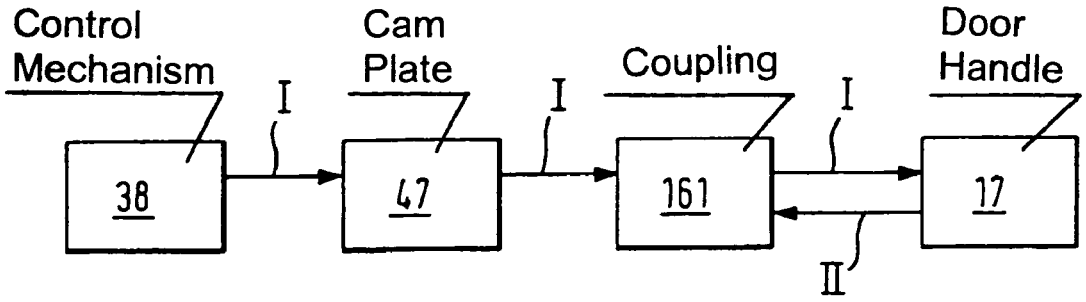
FIG. 21 is a block circuit diagram illustrating a fourth exemplary embodiment of a control flow of the door according to the invention.

A fourth exemplary embodiment of the invention is indicated in FIG. 21 by way of schematic block diagram. Accordingly, the control mechanism 38 transmits a drive movement, in a first arrow direction I, to the cam plate 47 and, further, to the door handle 17. A freewheel coupling 161 is connected between the cam plate 47 and the door handle 17. The freewheel coupling 161 allows transmission of movement from the cam plate 47 to the door handle 17 in the first arrow direction I.

When the door handle 17 is actuated, the freewheel coupling 161 is subjected to a pivoting movement in a second arrow direction II, counter to the first arrow direction I. During a transmission of pivoting movement from the door handle 17 to the freewheel coupling 161 in the second arrow direction II, the freewheel coupling, nevertheless, allows freewheeling. Transmission of movement from the door handle 17 to the control mechanism 38 is, thus, prevented. Accordingly, the freewheel coupling acts as a safeguarding device for the control mechanism 38 and prevents forces from being introduced into the control mechanism 38 from the door handle 17.

We claim:

1. A household cooking appliance, comprising:

a housing having a hinge pin; and a household appliance door to be mounted pivotally about a hinge pin, the household appliance door being pivotable between a closed position in which the door closes a compartment of a household appliance and an open position in which the door opens the compartment of the household appliance, the door including a door body configured to pivot about the hinge pin, said door body having a door handle pivotally disposed in said door body about a door handle axis disposed parallel the hinge pin and at least one control mechanism operatively connected to said door handle to, during a door opening movement involving a pivoting of said door body from the closed position to the open position, pivot said door handle about said door handle axis in a second handle pivoting direction opposite to a first handle pivoting direction, said one control mechanism including a cable having one end attached to said door handle at a one cable end attachment and another end attached to the door at an other cable end attachment, said one cable end attachment being attached to said door handle at a radial spacing from said door handle axis such that said one cable end attachment undergoes angular position changes relative to said door handle axis during pivoting of said door handle, and means for permitting movement of said other cable end attachment in correspondence with angular position changes of said one end attachment of the cable such that the effective length of said cable between its one cable end attachment and its other cable end attachment remains substantially constant, and a safeguarding device having a safeguarding length extent with one end attached to said door handle at a radial spacing from said door handle axis and another end attached to a resilient force absorbing element, said resilient force absorbing element being operable to resiliently resist pivoting of said door handle in said second handle pivoting direction and said resilient force absorbing element and said means for permitting movement of said other cable end attachment in correspondence with angular position changes of said one end attachment of the cable being compatibly configured with one another such that, when the door is in the closed position and said door handle is pivoted in said second pivoting direction while the door remains in the closed position, said resilient force absorbing element resiliently resists pivoting of said door handle in said second handle pivoting direction to a prescribed degree so as to reduce the transmission of forces resulting from said pivoting movement of said door handle to said at least one control mechanism.

2. A household appliance door to be mounted pivotally about a hinge pin, the household appliance door being pivotable between a closed position in which the door closes a compartment of a household appliance and an open position in which the door opens the compartment of the household appliance, the door comprising:

a door body configured to pivot about the hinge pin, said door body having:

a door handle pivotally disposed in said door body about a door handle axis disposed parallel the hinge pin; and at least one control mechanism operatively connected to said door handle to, during a door opening movement involving a pivoting of said door body from the closed position to the open position, pivot said door handle about said door handle axis in a second handle pivoting direction opposite to a first handle pivoting direction, said one control mechanism including a cable having one end attached to said door handle at a one cable end attachment and another end attached to the door at an other cable end attachment, said one cable end attachment being attached to said door handle at a radial spacing from said door handle axis such that said one cable end attachment undergoes angular position changes relative to said door handle axis during pivoting of said door handle, and means for permitting movement of said other cable end attachment in correspondence with angular position changes of said one end attachment of the cable such that the effective length of said cable between its one cable end attachment and its other cable end attachment remains substantially constant, and a safeguarding device having a safeguarding length extent with one end attached to said door handle at a radial spacing from said door handle axis and another end attached to a resilient force absorbing element, said resilient force absorbing element being operable to resiliently resist pivoting of said door handle in said second handle pivoting direction and said resilient force absorbing element and said means for permitting movement of said other cable end attachment in correspondence with angular position changes of said one end attachment of the cable being compatibly configured with one another such that, when the door is in the closed position and said door handle is pivoted in said second pivoting direction while the door remains in the closed position, said resilient force absorbing element resiliently resists pivoting of said door handle in said second handle pivoting direction to a prescribed degree so as to reduce the transmission of forces resulting from said pivoting movement of said door handle to said at least one control mechanism.

3. The household appliance door according to claim 2, wherein said at least one control mechanism and said safeguarding device are contained within the door in a manner in which said control mechanism is inoperative, and said door is configured for being mounted on a household appliance in a manner causing said control mechanism to become operative.

4. The household-appliance door according to claim 2, wherein said resilient force absorbing element includes a spring element that, when said pivoting movement of said door handle is transmitted from said door handle to said control mechanism, absorbs movement of said door handle.

5. The household-appliance door according to claim 4, wherein said spring element exerts a first torque in a pivoting direction of said door handle.

6. The household-appliance door according to claim 5, wherein said control mechanism subjects said door handle to a second torque counteracting said first torque.

7. The household-appliance door according to claim 6, wherein said control mechanism has a first pulling element connecting said spring element to said door handle and exerting said first torque on said door handle at a first lever-arm distance spaced apart from said door-handle axis.

8. The household-appliance door according to claim 7, wherein said control mechanism has a second pulling element exerting said second torque on said door handle at a second lever-arm distance spaced apart from said door-handle axis.

9. The household-appliance door according to claim 8, wherein at least one of said first and second lever-arm lengths change dependent upon a pivoting position of said door handle.

10. The household-appliance door according to claim 8, wherein at least one of said control mechanism, said first pulling element, and said second pulling element are connected to keep at least one of said first and second lever-arm lengths constant regardless of a pivoting position of said door handle.

11. The household-appliance door according to claim 8, wherein said control mechanism has at least one deflecting roller mounted on said door body and determining a course taken by at least one of said first and second pulling elements.

12. The household-appliance door according to claim 8, further comprising:

a cam plate rotationally fixed to said door handle and operatively connected to said first and second pulling elements; and said first and second pulling elements being guided in opposite directions over said cam plate.

13. The household-appliance door according to claim 12, wherein said cam plate defines said first lever-arm distance and said second lever-arm distance; and said first lever-arm distance is greater than said second lever-arm distance.

14. The household-appliance door according to claim 12, further comprising a drive part connected to said door handle; and said control mechanism having one of said first and second pulling elements connected to said drive part and closed in a loop for transmitting rotary movement of said drive part to said door handle.

15. The household-appliance door according to claim 12, wherein:

said control mechanism has a pulley; and a drive part is connected to said door handle and to said pulley in a closed loop and transmitting rotary movement of said drive part to said door handle.

16. The household-appliance door according to claim 14, wherein said control mechanism has a tensioner for tensioning said one of said first and second pulling elements.

17. The household-appliance door according to claim 14, wherein said control mechanism has a means for tensioning said one of said first and second pulling elements.

18. The household-appliance door according to claim 8, wherein:

said door body has two opposite narrow sides; and said at least one control mechanism is two control mechanisms disposed on each of said two opposite narrow sides.

19. The household-appliance door according to claim 18, further comprising:

said spring element has two ends; and said second pulling element of each of said two control mechanisms is connected to a respective one of said two ends of said spring element.

20. The household-appliance door according to claim 2, further comprising a drive part connected to said door body and moving during a pivoting movement of said door body, said control mechanism operatively connected to said drive part.

21. The household-appliance door according to claim 20, further comprising:

a sliding track;

said drive part being a guide element and, during said pivoting movement of said door body, being guided in said sliding track; and said guide element interacting with said control mechanism to transmit a movement of said guide element to said control mechanism.

22. The household-appliance door according to claim 21, wherein:

said control mechanism has a drive shaft;

said guide element interacts with said drive shaft and rotates said drive shaft during said pivoting movement of said door body.

23. The household-appliance door according to claim 2, further comprising:

a hinge rod connected to said door body and moving during a pivoting movement of said door body, said control mechanism operatively connected to said hinge rod;

a hinge having a hinge part to be secured in a household appliance, said hinge having at least one spring as a weight-balancer that, during said pivoting movement of said door body, displaceably moves said hinge rod.

24. The household-appliance door according to claim 4, wherein said spring element is a tension spring having a spring force between approximately five and ten times greater than a minimum value for a spring force corresponding approximately to frictional forces having to be overcome to restore said door handle.

25. The household-appliance door according to claim 2, wherein the household appliance door is a cooking appliance door.

* * * * *